US010104726B2

(12) United States Patent
Yamashita et al.

(10) Patent No.: US 10,104,726 B2
(45) Date of Patent: Oct. 16, 2018

(54) LIGHT EMITTING DIODE DRIVE DEVICE AND ILLUMINATION DEVICE

(71) Applicant: Sharp Kabushiki Kaisha, Osaka-shi, Osaka (JP)

(72) Inventors: Atsushi Yamashita, Osaka (JP); Manabu Onozaki, Osaka (JP); Tsuyoshi Ono, Osaka (JP); Masataka Miyata, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 157 days.

(21) Appl. No.: 15/108,822

(22) PCT Filed: Dec. 10, 2014

(86) PCT No.: PCT/JP2014/082733
§ 371 (c)(1),
(2) Date: Jun. 29, 2016

(87) PCT Pub. No.: WO2015/114958
PCT Pub. Date: Aug. 6, 2015

(65) Prior Publication Data

US 2016/0330806 A1 Nov. 10, 2016

(30) Foreign Application Priority Data

Jan. 28, 2014 (JP) ..... 2014-013763

(51) Int. Cl.
*F21V 7/22* (2018.01)
*H05B 33/08* (2006.01)
*F21Y 115/10* (2016.01)

(52) U.S. Cl.
CPC ..... *H05B 33/0815* (2013.01); *F21V 7/22* (2013.01); *H05B 33/086* (2013.01);
(Continued)

(58) Field of Classification Search
CPC ..... F21V 9/16; F21V 7/22; H05B 33/0815; H05B 33/0818; H05B 33/0845; H05B 33/086; H05B 33/0887
See application file for complete search history.

(56) References Cited

U.S. PATENT DOCUMENTS

2006/0169998 A1 8/2006 Radkov et al.
2006/0226759 A1 10/2006 Masuda et al.
(Continued)

FOREIGN PATENT DOCUMENTS

JP 2770422 B2 7/1998
JP 2005-255895 A 9/2005
(Continued)

*Primary Examiner* — Douglas W Owens
*Assistant Examiner* — Jianzi Chen
(74) *Attorney, Agent, or Firm* — Keating & Bennett, LLP

(57) ABSTRACT

To provide a circuit for reducing an afterglow of secondary light, a circuit includes an LED (11) which includes an LED chip (13) and a KSF phosphor (15), and a first output circuit (5) and a second output circuit (6) which are coupled to a cathode (11C). When a PWM signal goes to "H", the first output circuit is driven thereby making IF flow from the cathode. When the PWM signal goes to "L", the first output circuit stops driving, and the second output circuit makes an offset current flow from the cathode.

9 Claims, 17 Drawing Sheets

(52) U.S. Cl.
CPC ..... *H05B 33/0818* (2013.01); *H05B 33/0845* (2013.01); *H05B 33/0887* (2013.01); *F21Y 2115/10* (2016.08)

(56) References Cited

U.S. PATENT DOCUMENTS

| | | | | |
|---|---|---|---|---|
| 2007/0108896 | A1 | 5/2007 | Hirosaki | |
| 2007/0205712 | A1* | 9/2007 | Radkov | C09K 11/0838 313/503 |
| 2008/0303409 | A1 | 12/2008 | Hirosaki | |
| 2009/0309502 | A1* | 12/2009 | Trattler | H05B 33/0818 315/160 |
| 2010/0091215 | A1 | 4/2010 | Fukunaga et al. | |
| 2010/0142189 | A1 | 6/2010 | Hong et al. | |
| 2011/0043101 | A1 | 2/2011 | Masuda et al. | |
| 2011/0215737 | A1* | 9/2011 | Poirier | H02M 3/156 315/297 |
| 2012/0261704 | A1* | 10/2012 | Meyer | C09K 11/02 257/98 |
| 2014/0049172 | A1* | 2/2014 | Bakk | H05B 33/0863 315/192 |
| 2014/0183578 | A1 | 7/2014 | Horie | |

FOREIGN PATENT DOCUMENTS

| | | | |
|---|---|---|---|
| JP | 2006-016413 | A | 1/2006 |
| JP | 2007-049114 | A | 2/2007 |
| JP | 2009-528429 | A | 8/2009 |
| JP | 2010-093132 | A | 4/2010 |
| JP | 5252107 | B2 | 7/2013 |
| KR | 10-2010-0127204 | A | 12/2010 |
| WO | 2009/110285 | A1 | 9/2009 |

* cited by examiner

- PWM PERIOD : 120Hz
- Duty : 25%
- RED PHOSPHOR : KSF PHOSPHOR
- GREEN PHOSPHOR : Eu-ACTIVATED β TYPE SiAlON PHOSPHOR

FIG. 17

| | | LED DRIVE CIRCUIT 130 | LED DRIVE CIRCUIT 30 | LED DRIVE CIRCUIT 32 | LED DRIVE CIRCUIT 33 |
|---|---|---|---|---|---|
| (1) | OFFSET CURRENT (mA) | 0 | 2 | 4 | 4 |
| (2) | PWM Duty (%) | 25 | 25 | 25 | 15 |
| (3) | IF (mA) | 50 | 46.0 | 41.8 | 61.2 |
| (4) | VF1(*1) (V) | 3.0 | 2.95 | 2.9 | 3.2 |
| (5) | VF2(*1) (V) OF OFFSET CURRENT | — | 2.4 | 2.4 | 2.4 |
| (6) | POWER(*2) (mW) | 37.5 | 37.5 | 37.5 | 37.5 |

*1:CALCULATED BY IF-VF CHARACTERISTICS (HERE, ROUGH CALCULATION)
*2:(6)POWER = (1) × (100%-(2)) × (5)+(2) × (3) × (4)

FIG. 18

| | | LED DRIVE CIRCUIT 130 | LED DRIVE CIRCUIT 34 |
|---|---|---|---|
| (1) | OFFSET CURRENT (mA) | 0 | 2 |
| (2) | PWM1 Duty (%) | 25 | 25 |
| (7) | PWM2 Duty (%) | — | 25 |
| (3) | IF (mA) | 50 | 44.9 |
| (4) | VF1(*1) (V) | 3.0 | 2.95 |
| (5) | VF2(*1) (V) OF OFFSET CURRENT | — | 2.4 |
| (6) | POWER(*2) (mW) | 37.5 | 37.5 |

PWM PERIOD : 8.33ms (120Hz)
PWM Duty : 25%
AMOUNT OF LIGHT OF KSF 100%

LIGHT EMITTING DIODE DRIVE DEVICE AND ILLUMINATION DEVICE

TECHNICAL FIELD

The present invention relates to a light emitting diode drive device and an illumination device.

BACKGROUND ART

For a backlight which is used for a so-called liquid crystal television (TV), an LED chip which emits blue light as primary light, a red phosphor which is excited by the blue light and emits red light as secondary light, and a green phosphor which emits green light are used. The backlight is emitted as white light which is obtained by mixing blue light, green light, and red light.

PTL 1 discloses a light emitting element which emits white light by exciting divalent Eu-activated $CaAlSiN_3$ (hereinafter, referred to as CASN phosphor) that is a nitride-based phosphor for emitting red light, and a green phosphor that emits green light, using an LED for emitting blue light.

In addition, an Eu-activated β type SiAlON phosphor which is disclosed in, for example, PTL 2 has been appropriately used in the related art, as a phosphor which emits green light.

In a case where an illumination which emits white light by combining a blue LED, a red phosphor, and a green phosphor is used as a light source of a backlight of a liquid crystal television, there is tendency that color reproducibility of the liquid crystal television is improved by using a phosphor having a narrower peak wavelength of a emission spectrum.

However, in a case where the CASN phosphor which is a phosphor disclosed in PTL 1 is used, a wavelength width of the emission spectrum of the red phosphor is equal to or greater than 80 nm, and thus, the color reproducibility of red is not sufficient.

Accordingly, in order to realize a display device such as a liquid crystal television which can display deep red, development of a backlight which uses a $Mn^{4+}$-activated $K_2SiF_6$ phosphor (hereinafter, referred to as KSF phosphor) disclosed in PTL 3 is in progress. A KSF phosphor has a spectrum of peak wavelength narrower than that of a CASN phosphor, and can have further improved color reproducibility than a case where a CASN phosphor is used.

CITATION LIST

Patent Literature

PTL 1: Japanese Unexamined Patent Application Publication No. 2006-16413 (published on Jan. 19, 2006)

PTL 2: Japanese Unexamined Patent Application Publication No. 2005-255895 (published on Sep. 22, 2005)

PTL 3: Japanese Unexamined Patent Application Publication No. 2010-93132 (published on Apr. 22, 2010)

PTL 4: International Publication No. WO2009/110285 (published on Sep. 11, 2009)

PTL 5: Japanese Unexamined Patent Application Publication (Translation of PCT Application) No. 2009-528429 (published on Aug. 6, 2009)

PTL 6: Japanese Unexamined Patent Application Publication No. 2007-49114 (published on Feb. 22, 2007)

SUMMARY OF INVENTION

Technical Problem

Here, the majority of liquid crystal televisions display images at 60 Hz, 120 Hz, or 240 Hz which is an integer multiple of a frame frequency of a video signal. It is possible to realize a display in which an unwanted video is not shown to a user by temporarily extinguishing a backlight, using the fact that that an LED can light or extinguish at a high speed.

For example, an afterimage is reduced by temporarily extinguishing a backlight, while a video is replaced to the next frame on a liquid crystal screen. In addition, when a three-dimensional (3D) display is made by using a frame sequential method by which a video for the right eye and a video for the left eye are alternately displayed, video (cross-talk) that is obtained by mixing pictures of the right eye and the left eye can be reduced by temporarily extinguishing the backlight until the videos are displayed on the entire screen.

In a case where this function is performed, a pulse width modulation (PWM) drive method in which lighting and extinguishment is repeated is used as an LED drive method which is used for a backlight, but timing of the lighting and extinguishment is synchronized with a display of a liquid crystal panel, and thus, 60 Hz, 120 Hz, or 240 Hz which are integer multiples of the frame frequency of the video signal are mainly used as a PWM period.

If the red phosphor (KSF phosphor) described in PTL 3 is used, color reproducibility by obtaining light having a narrow spectrum can be improved, but the KSF phosphor has a time (also referred to as afterglow time) of approximately 10 [ms] which is taken until emission intensity becomes 1/e (e is base of natural logarithm), and is longer than the afterglow time of a CASN phosphor by approximately 100 to 1000 times.

Accordingly, in a case where an LED is lighted or extinguished at a dimming frequency (PWM dimming) which is synchronized with a display of a liquid crystal panel, even at a timing in which blue light having a rectangular waveform from an LED chip of the LED is extinguished, as illustrated in FIG. 19, afterglow of red light from a KSF phosphor which is excited by blue light from the LED chip and emits light exists. Due to the afterglow of red light from the KSF phosphor, abnormality such as a phenomenon in which a displayed video is shown with color or a phenomenon in which videos for the right eye and the left eye to be shown at the time of a 3D display are mixed, that is, a so-called crosstalk phenomenon, occurs. For example, the crosstalk remarkably occurs in a video or the like in which telop characters flow on the screen, and a part of the telop is shown in red.

FIG. 19 illustrates a response waveform of the KSF phosphor when a backlight having a PWM drive frequency of 120 Hz and a duty cycle of 25% is driven.

The present invention is to solve the above problems, and an object thereof is to obtain a light emitting diode drive device which reduces an afterglow of secondary light and an illumination device.

Solution to Problem

In order to solve the above problems, according to an aspect of the present invention, there is provided a light emitting diode drive device including a light emitting diode which includes a light emitting diode chip being driven by a drive current that changes depending on a signal level of a square wave and which emits primary light with brightness corresponding to the drive current, and a phosphor which is excited by the primary light and emits secondary light, and which emits mixed light that is obtained by mixing the primary light with the secondary light; and first and second output circuits which are coupled to the light emitting diode chip and are coupled to an output terminal of the light emitting diode from which the drive current is output, respectively. The first output circuit is driven when the signal level of the square wave is an "H" level thereby making the light emitting diode chip emit light as a first current is output from the output terminal, and stops driving when the signal level of the square wave is an "L" level. The second output circuit makes the light emitting diode chip emit light as a second current whose current value is less than that of the first current is output from the output terminal, when the signal level of the square wave is an "L" level.

Advantageous Effects of Invention

According to the aspect of the present invention, it is possible to obtain a light emitting diode drive device which reduces an afterglow of secondary light, and an illumination device.

BRIEF DESCRIPTION OF DRAWINGS

FIG. 17 is a diagram illustrating an example of values of each signal which is used for the LED drive circuits according to each embodiment.

FIG. 18 is a diagram illustrating an example of values of each signal which is used for LED drive circuits 130 according to the first comparative example and an LED drive circuit according to Embodiment 5.

DESCRIPTION OF EMBODIMENTS

Embodiment 1

Hereinafter, Embodiment 1 according to the present disclosure will be described in detail.

(Configuration of Illumination Device 1)

Figure 2:
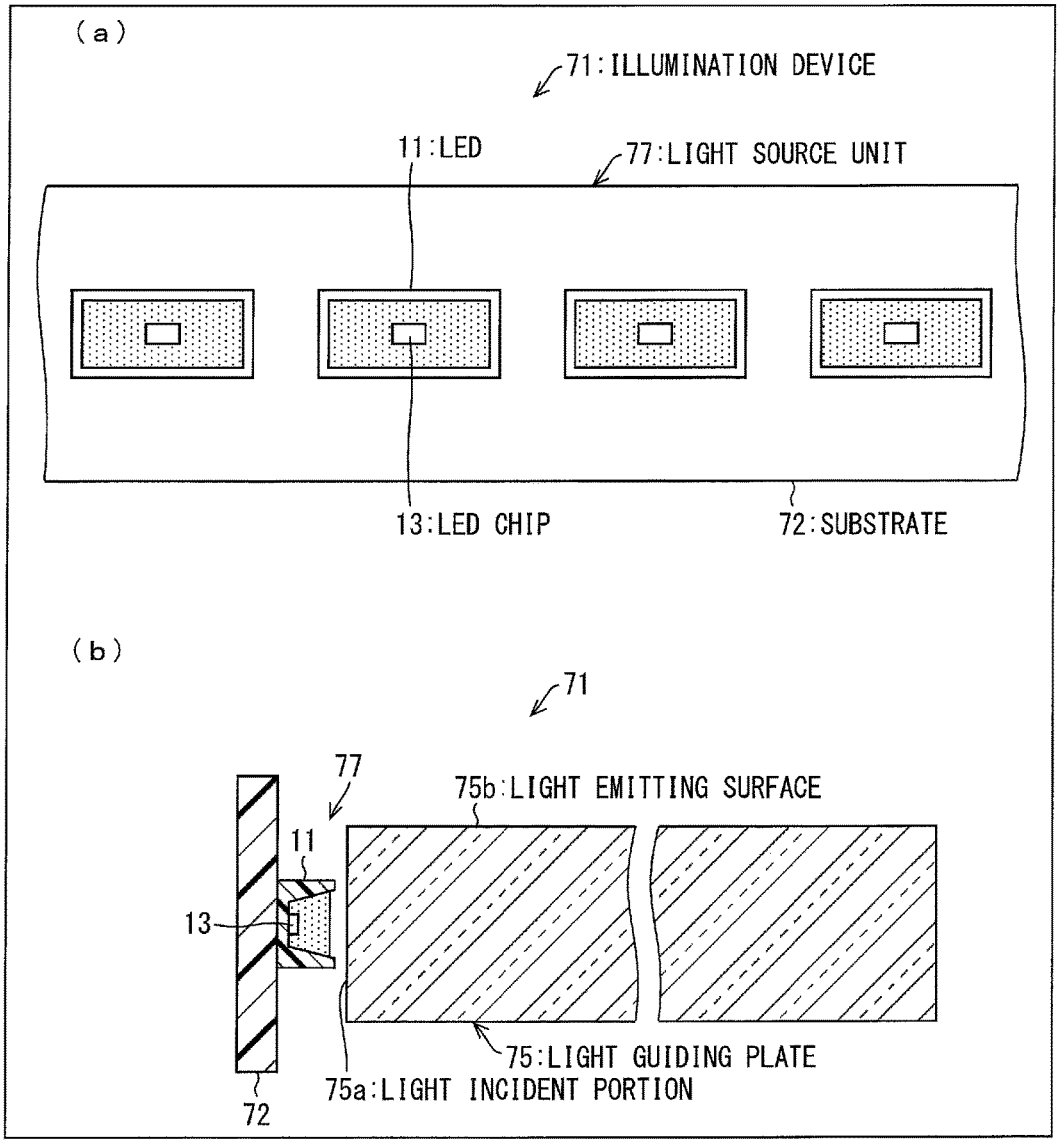
FIG. 2(*a*) is an expanded plan view illustrating a part of an illumination device which uses the LED according to Embodiment 1, and FIG. 2(*b*) is a sectional view illustrating the illumination device illustrated in FIG. 2(*a*).

In the beginning, an illumination device 71 which uses an LED (light emitting diode) 11 according to the present embodiment will be described. FIG. 2(*a*) is an expanded plan view illustrating a part of the illumination device 71 which uses the LED 11 according to Embodiment 1, and FIG. 2(*b*) is a sectional view of the illumination device 71 illustrated in FIG. 2(*a*).

As illustrated in FIGS. 2(*a*) and 2(*b*), the illumination device 71 includes a substrate 72, multiple LEDs 11 and a light guiding plate 75. The illumination device 71 also includes an LED drive control unit (refer to FIG. 1), which is not illustrated in FIG. 2, for controlling driving of the multiple LEDs 11.

The entire light guiding plate 75 has a rectangular shape, and is a transparent member having a predetermined thickness. The light guiding plate 75 has a structure in which light is emitted from each portion of a light emitting surface 75*b*, such that light which is incident from a light incident portion 75*a* is emitted in a plane shape, and is formed of a transparent material such as acryl. In addition, an end surface on one side of the light guiding plate 75 functions as the light incident portion 75*a* on which light is incident.

The substrate 72 is formed in an elongated rectangle (strip shape). In the substrate 72, printed wires (not illustrated) through which power is transferred to the LED 11 are formed on a mounting surface on which multiple LEDs 11 are mounted. In addition, a positive terminal (not illustrated) and a negative terminal (not illustrated) which are coupled to the printed wires are provided at both end portions or one end portion of the substrate 72. Wires through which power is supplied from the outside are coupled to the positive terminal and the negative terminal, and thereby the LED 11 receives power.

The multiple LEDs 11 are mounted in a line in a longitudinal direction of the substrate 72 on the substrate 72. The multiple LEDs 11 are coupled in series in a longitudinal direction of the substrate 72.

The substrate 72 and the LEDs 11 configure a light source unit 77. A light emitting surface of each of the multiple LEDs 11 faces the light incident portion 75*a*, and the light source unit 77 is disposed at a location closed to the light guiding plate 75, such that light which is emitted from an LED chip (light emitting diode chip) 13 of each of the multiple LEDs 11 is incident on the light incident portion 75*a* of the light guiding plate 75.

(LED Drive Circuit 30)

Figure 1:
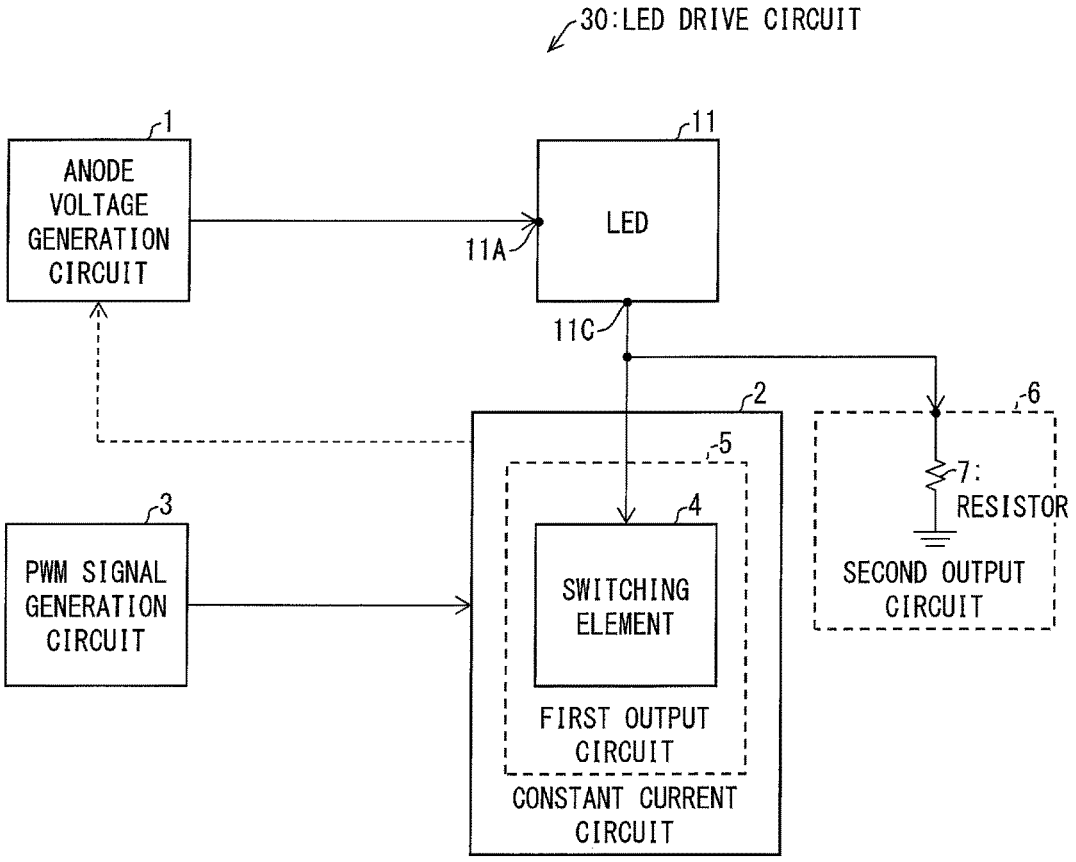
FIG. 1 is a block diagram illustrating a configuration of an LED drive circuit according to Embodiment 1.

A configuration of an LED drive circuit (light emitting diode drive device) 30 included in an illumination device 71 will be described with reference to FIG. 1. FIG. 1 is a block diagram illustrating the configuration of the LED drive circuit 30 according to Embodiment 1.

The LED drive circuit 30 includes an anode voltage generation circuit 1, a constant current circuit 2 which includes a first output circuit 5, a PWM signal generation circuit (PWM signal generation unit) 3, a second output circuit 6, and the LED 11. The first output circuit 5 is configured with a switching element 4. The second output circuit 6 is configured with a resistor 7.

The LED 11 includes an anode 11A which is an input terminal of a forward current flowing through the LED chip 13, and a cathode 11C which is an output terminal from which the forward current flowing through the LED chip 13 is output to the outside of the LED 11. The LED drive circuit 30 includes multiple LEDs 11, and the respective multiple LEDs 11 are coupled in series or in parallel. The number of the LED 11 included in the LED drive circuit 30 may be only one.

As an anode voltage signal from the anode voltage generation circuit 1 is input to the LED 11 and IF (forward current (drive current)) flows through the LED chip 13, the LED 11 emits white light.

The anode voltage generation circuit 1 outputs the anode voltage signal which is required for lighting the LED 11. The anode voltage generation circuit 1 outputs the generated anode voltage signal to the anode 11A of the LED 11, thereby supplying VF (forward voltage) which is required for lighting the LED 11.

The constant current circuit 2 is coupled to the PWM signal generation circuit 3, the cathode 11C of the LED 11, and the second output circuit 6. The PWM signal generation circuit 3 is coupled to the constant current circuit 2 and the switching element 4 which is the first output circuit 5. The anode voltage generation circuit 1 is coupled to the constant current circuit 2 and the anode 11A of the LED 11. In the LED 11, the anode 11A is coupled to the anode voltage generation circuit 1, the cathode 11C is coupled to the switching element 4, and is coupled to one terminal of the resistor 7 which is the second output circuit. The one terminal of the resistor 7 is coupled to the cathode 11C of the LED 11, and the other terminal of the resistor 7 is electrically grounded.

The constant current circuit 2 supplies a constant current to the LED 11, thereby lighting the LED 11 using a constant current.

The constant current circuit 2 sets a value of IF flowing through the LED chip 13 of the LED 11, thereby being able to be represented by an LED driver, a constant current driver, or the like.

The switching element 4 is embedded in the constant current circuit 2, and is coupled to the PWM signal generation circuit 3 and the cathode 11C of the LED 11. The switching element 4 is turned on or off in correspondence with a frequency and a duty cycle of a PWM signal which is input from the PWM signal generation circuit 3. The switching element 4 is ON (turned on) when a signal level of the PWM signal is in an "H", and the switching element 4 is OFF (turned off) when the signal level of the PWM signal is in an "L". In other words, while the switching element 4 is turned on and thereby the first output circuit 5 is driven, the switching element 4 is OFF and thereby driving of the first output circuit 5 is stopped.

By doing so, the LED 11 repeats lighting which is made by a constant current, and extinguishing.

Various switching elements such as an Nch FET can be used as the switching element 4.

In addition, the constant current circuit 2 may monitor a voltage which is input to the switching element 4, may feed back the voltage to the anode voltage generation circuit 1 in accordance with a value of VF (forward voltage) of the LED 11, and may have a function which can be adjusted to an appropriate voltage. In this case, the constant current circuit 2 is coupled to the anode voltage generation circuit 1, and outputs a feedback signal for adjusting an anode voltage in accordance with VF of the LED 11 to the anode voltage generation circuit 1.

Specifically, a voltage which is input to the switching element 4 is a voltage (referred to as an adjustment voltage) which is obtained by subtracting a VF value required for lighting the LED 11, from a voltage that is output from the anode voltage generation circuit 1, when the switching element 4 is turned on.

The constant current circuit 2 compares the adjustment voltage with a predetermined reference voltage. In addition, the constant current circuit 2 outputs a feedback signal which commands boosting of the anode voltage to the anode voltage generation circuit 1, in a case where the adjustment voltage is lower than the reference voltage. By doing so, the anode voltage generation circuit 1 boosts the anode voltage. Meanwhile, the constant current circuit 2 outputs the feedback signal which commands dropping of the anode voltage to the anode voltage generation circuit 1, in a case where the adjustment voltage is higher than the reference voltage. By doing so, the anode voltage generation circuit 1 drops the anode voltage.

In this way, the constant current circuit 2 can generate the appropriate anode voltage in accordance with the VF value of the LED 11. The reference voltage may be generated by the constant current circuit 2 or may be supplied from the outside.

More specifically, if the reference voltage is 1.0 V, the constant current circuit 2 outputs the feedback signal which boosts the anode voltage to the anode voltage generation circuit 1, in a case where a voltage which is input to the switching element 4 is lower than 1.0 V. In addition, in a case where the voltage which is input to the switching element 4 is higher than 1.0 V, the constant current circuit 2 outputs the feedback signal which drops the anode voltage to the anode voltage generation circuit 1.

The PWM signal generation circuit 3 generates a PWM signal which is a dimming signal that is a pulse signal configured by High (first level. Hereinafter, referred to as "H") and/or Low (second level. Hereinafter, referred to as "L"), and outputs the generated PWM signal to the constant current circuit 2. In addition, the PWM signal generation circuit 3 can change a frequency and a duty cycle of the PWM signal by external control.

Hereinafter, it will be described that the switching element 4 is ON when the PWM signal is in an "H" and is OFF when the PWM signal is in an "L". However, the invention is not limited to this, and the switching element 4 may be ON when the PWM signal is in an "L" (first level), and may be OFF when the PWM signal is in an "H" (second level).

The second output circuit 6 makes a current flow into the LED 11 from the cathode 11C of the LED 11 through the resistor 7. A resistance value of the resistor 7 is determined by a voltage value of the cathode 11C of the LED 11 and a current (IF) value flowing through the LED 11. Even in a case where the switching element 4 is OFF, a current flows into the LED 11 through the resistor 7, and the LED 11 is lit. In other words, in the present embodiment, the second output circuit 6 is driven at all times, regardless of a drive state of the first output circuit 5.

In this way, in the LED drive circuit 30, the LED 11 is lit at all times regardless of ON/OFF of the switching element 4, and thus, it is preferable that a function which can activate or deactivate the anode voltage generation circuit 1 by external control is provided.

When the switching element 4 is ON, IF (first current) flows into the switching element 4 of the first output circuit 5 and the resistor 7 of the second output circuit 6 from the cathode 11C, and thus the LED 11 emits white light. Meanwhile, when the switching element 4 is OFF, an offset current (second current) flows into only the resistor 7 of the second output circuit 6 among the first output circuit 5 and the second output circuit 6 from the cathode 11C, and thus, the LED 11 emits white light.

A value of an offset current flowing through the LED 11 when the switching element 4 is OFF, is smaller than a value of IF flowing through the LED 11 when the switching element 4 is ON. For this reason, brightness of the LED 11 which is lit when the switching element 4 is OFF, is lower than brightness of the LED 11 which is lit when the switching element 4 is ON.

(Configuration of LED 11)

Figure 3:
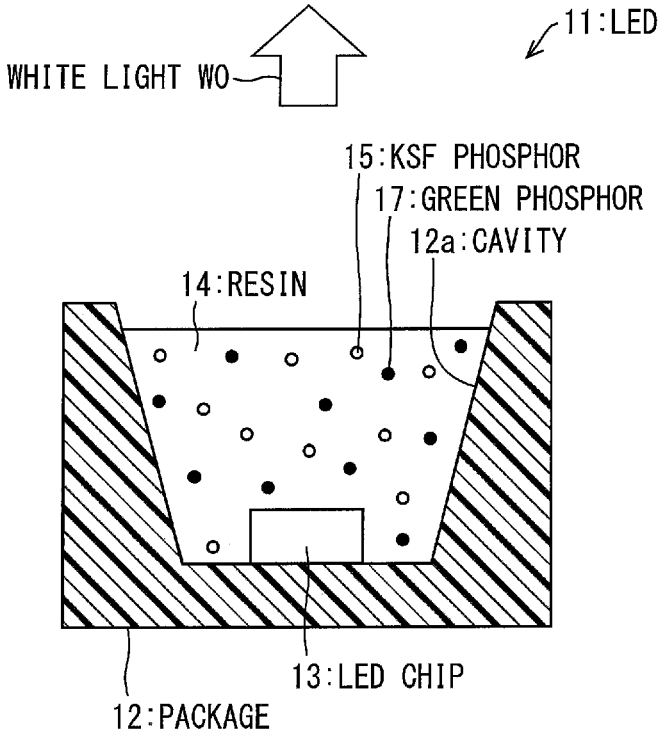
FIG. 3 is sectional view of an LED according to Embodiment 1.

A configuration of the LED 11 will be described in detail with reference to FIG. 3. FIG. 3 is a sectional view of the LED 11.

The LED 11 includes the LED chip 13 in a central portion thereof as an example as illustrated in FIG. 3. The LED 11 includes a package 12, the LED chip 13, a resin 14, a KSF phosphor (phosphor, red phosphor, $Mn^{4+}$-activated complex fluoride phosphor) 15, and a green phosphor (green color phosphor) 17.

The package 12 has a cavity (concave portion) 12*a* which is a concave portion. The cavity 12*a* is a space which is provided in the package 12, such that the LED chip 13 is mounted on a bottom surface in the concave portion and a side surface of the concave portion is used as a reflecting surface. The package 12 is formed of a nylon-based material, and is provided by insert molding such that a lead frame (not illustrated) is exposed on the bottom surface in the cavity 12*a* of the package 12. The lead frame is divided into two parts at an exposed portion.

The package 12 includes a reflecting surface which forms an inner side surface of the cavity 12*a* which is a concave portion. It is preferable that the reflecting surface is formed of a metal film with high reflectance including Ag or Al, or white silicone, such that light which is emitted from the LED chip 13 is reflected to the outside of the LED 11.

The LED chip 13 emits primary light with brightness corresponding to a current which changes in accordance with a signal level of the PWM signal.

The LED chip 13 is, for example, a gallium nitride(GaN)-based semiconductor light emitting element including a conductive substrate, and while not illustrated, a bottom surface electrode is formed on a bottom surface of the conductive substrate and an upper electrode is formed on a reverse surface thereof. The emitted light (primary light) of the LED chip 13 is blue light whose peak wavelength is in a range of 430 nm to 480 nm, and particularly, has a peak wavelength in the vicinity of 450 nm.

In addition, the LED chip 13 (blue LED chip) is die-bonded to one side of the exposed portion in the lead frame by a low conductive material. Furthermore, in the LED chip 13, the upper electrode of the LED chip 13 and the other side of the exposed portion in the lead frame are die-bonded together by a wire (not illustrated). In this way, the LED chip 13 is electrically coupled to the lead frame. Here, the LED chip respectively having electrodes on the upper surface and a lower surface is described, but it is also possible to use an LED having two electrodes on the upper surface.

The cavity 12*a* is filled with the resin 14, and thereby the cavity 12*a* in which the LED chip 13 is disposed is sealed. In addition, since the resin 14 needs to have high durability with respect to primary light with a short wavelength, a silicone resin is appropriately used. A surface of the resin 14 forms a light emitting surface from which light is emitted.

The KSF phosphor 15 which is excited by the primary light emitted from the LED chip 13 and emits red light as the secondary light, and the green phosphor 17 which emits green light, are distributed in the resin 14.

The KSF phosphor 15 is a phosphor (hereinafter, there is a case of being referred to as a phosphor of a forbidden transition type) which emits red light by forbidden transition.

The red phosphor (phosphor) which is distributed in the resin 14 is a phosphor which emits red light by the forbidden transition. Particularly, it is preferable that the red phosphor is formed of a phosphor material with a narrow spectrum of wavelength width of peak wavelength equal to or narrower than 30 nm.

At least a phosphor of the forbidden transition type may be distributed as the red phosphor which is distributed in the resin 14. In addition, two types of phosphors such as the phosphor of the forbidden transition type and a phosphor (hereinafter, there is a case of being referred to as a phosphor of an allowed transition type) which emits red light by the allowed transition like a CASN phosphor may be distributed in the resin 14 as a red phosphor. Furthermore, three types or more of red phosphors may be distributed. In addition, the green phosphor 17 may be distributed in the resin 14 and may not be, if necessary.

The KSF phosphor 15 is distributed in the resin 14, and is an example of the red phosphor which emits red light by the forbidden transition. The KSF phosphor 15 is excited by blue light which is a primary light, and emits secondary light of red (peak wavelength is equal to or longer than 600 nm and is equal to or shorter than 780 nm) having a wavelength longer than that of the primary light. The KSF phosphor 15 is a phosphor having a $Mn^{4+}$-activated $K_2SiF_6$ structure.

The KSF phosphor 15 emits red light which has a wavelength width of peak wavelength that is narrowed to approximately 30 nm or less and has high purity.

Figure 4:
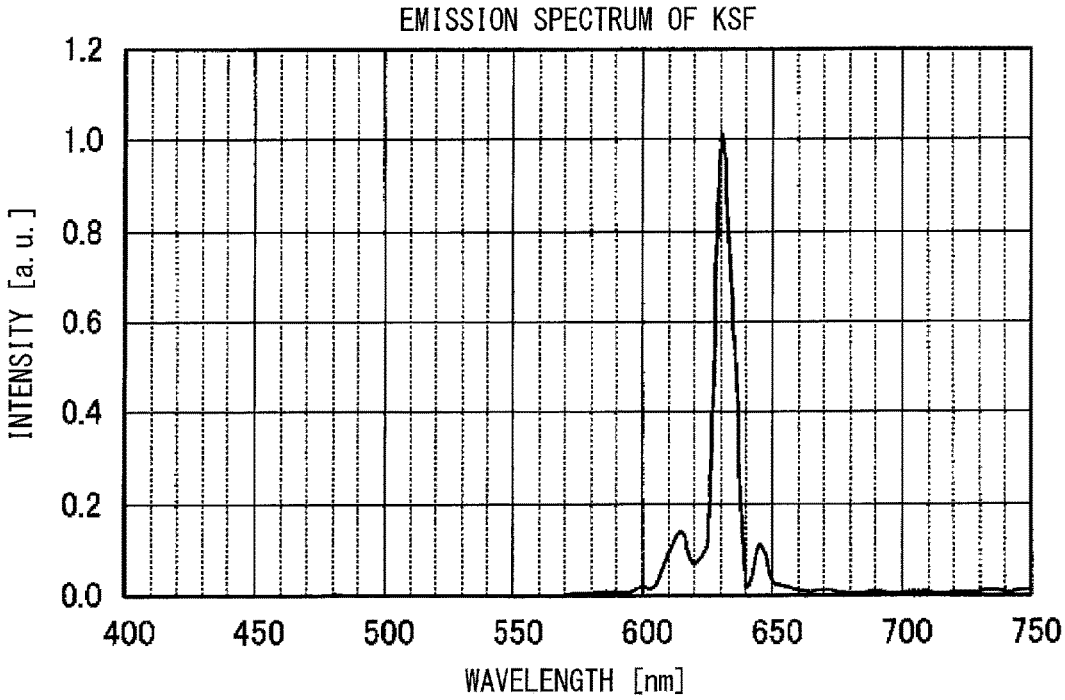
FIG. 4 is a diagram illustrating a emission spectrum of a KSF phosphor.
Figure 5:
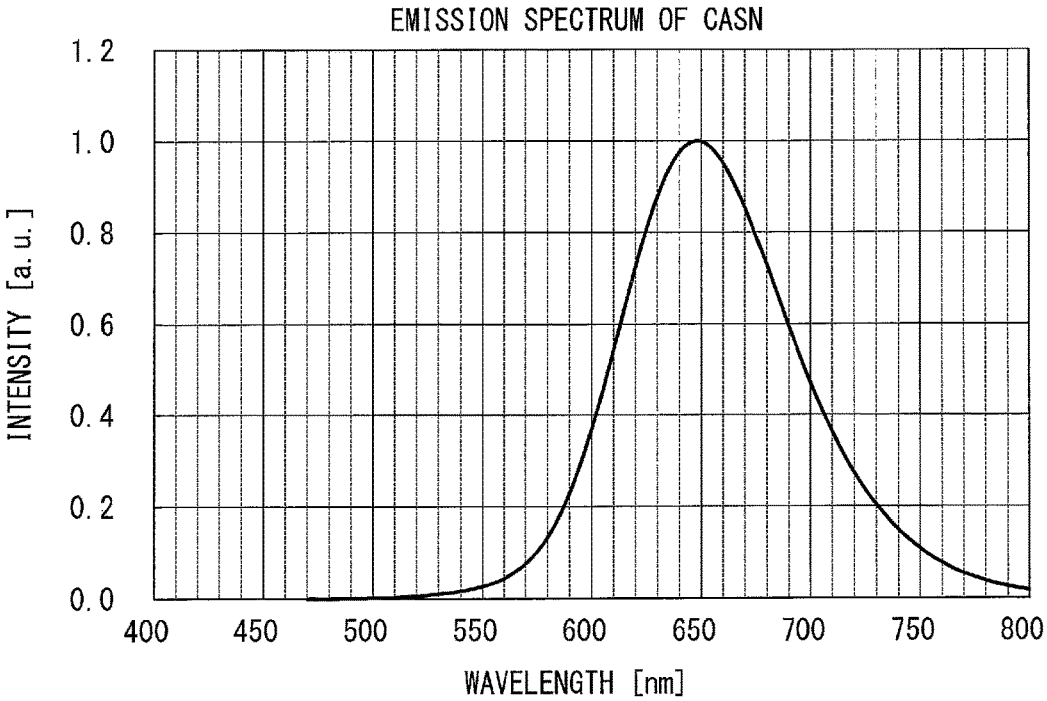
FIG. 5 is a diagram illustrating a emission spectrum of a CASN phosphor.

FIG. 4 is a diagram illustrating a emission spectrum of a KSF phosphor 15. FIG. 5 is a diagram illustrating a emission spectrum of a CASN phosphor.

As illustrated in FIG. 4 and FIG. 5, it can be seen that the KSF phosphor 15 which is a phosphor of a forbidden transition type has a narrow spectrum whose peak wavelength width near 630 nm is narrower than that of the CASN phosphor which is a phosphor of an allowed transition type. It is preferable that a wavelength width of peak wavelength of the emission spectrum is approximately equal to or less than 30 nm, like in the KSF phosphor 15. In this way, proportion including a wavelength region of color other than a wavelength region of red aiming to emit light is low in a emission spectrum which is a spectrum having a narrow wavelength width of peak wavelength of a emission spectrum. In addition, a wavelength region of red aiming to emit light is more clearly separated from a wavelength region of color other than that. For this reason, it is possible to obtain the LED 11 with wide color reproducibility.

The KSF phosphor 15 has a slow response speed at the time of extinguishing light from the LED chip 13. The afterglow time of the KSF phosphor 15 which is time required until emission intensity of secondary light from the KSF phosphor 15 becomes 1/e (e is base of natural logarithm) when primary light from the LED chip 13 is extinguished, is approximately 7 ms to 8 ms. In addition, in order for the secondary light from the KSF phosphor 15 to be almost completely on or extinguished, approximately 10 ms is needed.

In addition, the afterglow time of the CASN phosphor which is time required until emission intensity of secondary light from the CASN phosphor becomes 1/e (e is base of natural logarithm) when primary light from the LED chip 13 is extinguished, is approximately 1 μs to 10 μs.

That is, the afterglow of the KSF phosphor which is a phosphor of the forbidden transition type is longer than that of the CASN phosphor which is a phosphor of the allowed transition type by 100 times to 1000 times. In other words, the response speed of the KSF phosphor which is a phosphor of the forbidden transition type is slower than that of the CASN phosphor which is a phosphor of the allowed transition type by 100 times to 1000 times.

In addition to the phosphor having the $Mn^{4+}$-activated $K_2SiF_6$ structure, a $Mn^{4+}$-activated Mg fluorogermanate phosphor or the like can be used as a material which can be used as the red phosphor having a narrow wavelength width of peak wavelength. Furthermore, the red phosphor which emits red light by forbidden transition may be one of $Mn^{4+}$-activated complex fluoride phosphors represented by following general formulas (A1) to (A8).

$A_2[MF_5]:Mn^{4+}$ general formula (A1)

(in the above general formula (A1), A is selected from any one of Li, Na, K, Rb, Cs, and $NH_4$, or from a combination of those, and M is selected from any one of A1, Ga, and In, or from a combination of those)

$A_3[MF_6]:Mn^{4+}$ general formula (A2)

(in the above general formula (A2), A is selected from any one of Li, Na, K, Rb, Cs, and $NH_4$, or from a combination of those, and M is selected from any one of A1, Ga, and In, or from a combination of those)

$Zn_2[MF_7]:Mn^{4+}$ general formula (A3)

(in the above general formula (A3), M in [ ] is selected from any one of A1, Ga, and In, or from a combination of those)

$A[In_2F_7]:Mn^{4+}$ general formula (A4)

(in the above general formula (A4), A is selected from any one of Li, Na, K, Rb, Cs, and $NH_4$, or from a combination of those)

$A_2[MF_6]:Mn^{4+}$ general formula (A5)

(in the above general formula (A5), A is selected from any one of Li, Na, K, Rb, Cs, and $NH_4$, or from a combination of those, and M is selected from any one of Ge, Si, Sn, Ti, and Zr, or from a combination of those)

$E[MF_6]:Mn^{4+}$ general formula (A6)

(in the above general formula (A6), E is selected from any one of Mg, Ca, Sr, Ba, and Zn, or from a combination of those, and M is selected from any one of Ge, Si, Sn, Ti, and Zr, or from a combination of those)

$Ba_{0.65}Zr_{0.35}F_{2.70}:Mn^{4+}$ general formula (A7)

$A_3[ZrF_7]:Mn^{4+}$ general formula (A8)

(in the above general formula (A8), A is selected from any one of Li, Na, K, Rb, Cs, and $NH_4$, or from a combination of those)

Furthermore, the red phosphor which is distributed in the resin 14 may be a tetravalent manganese-activated fluoride tetravalent metal salt phosphor which is actually represented by, for example, the following general formula (A9) or the general formula (A10), in addition to the phosphor having the $Mn^{4+}$-activated $K_2SiF_6$ structure.

$MII_2(MIII_{1-h}Mn_h)F_6$ general formula (A9)

In the general formula (A9), MII indicates at least one type of Alkali metal element which is selected from Li, Na, K, Rb, and Cs, and it is preferable that MII is K from brightness and stability of powder characteristics. In addition, in the general formula (A9), MIII indicates at least one type of tetravalent metal element which is selected from Ge, Si, Sn, Ti, and Zr, and it is preferable that MIII is Ti from brightness and stability of powder characteristics.

In the general formula (A9), a value of h which indicates a composition ratio (concentration) of Mn is $0.001 \leq h \leq 0.1$. In a case where the value of h is less than 0.001, there is abnormality that sufficient brightness is not obtained. In addition, in a case where the value of h exceeds 0.1, there is abnormality that brightness is significantly reduced due to concentration quenching or the like. It is preferable that the value of h is $0.005 \leq h \leq 0.5$ from brightness and stability of powder characteristics.

Specifically, $K_2(Ti_{0.99}Mn_{0.01})F_6$, $K_2(Ti_{0.9}Mn_{0.1})F_6$, $K_2(Ti_{0.999}Mn_{0.001})F_6$, $Na_2(Zr_{0.98}Mn_{0.02})F_6$, $CS_2(Si_{0.95}Mn_{0.05})F_6$, $CS_2(Sn_{0.98}Mn_{0.02})F_6$, $K_2(Ti_{0.88}Zr_{0.10}Mn_{0.02})F_6$, $Na_2(Ti_{0.75}Sn_{0.20}Mn_{0.05})F_6$, $CS_2(Ge_{0.999}Mn_{0.001})F_6$, $(K_{0.80}Na_{0.20})_2(Ti_{0.69}Ge_{0.30}Mn_{0.05})F_6$ or the like can be used as the red phosphor which is represented by the general formula (A9), but the red phosphor is not limited to this.

$MIV(MIII_{1-h}Mn_h)F_6$ general formula (A10)

In the general formula (A10), MIII indicates at least one type of tetravalent metal element which is selected from Ge, Si, Sn, Ti, and Zr, as well as MIII in the aforementioned general formula (A9), and it is preferable that MIII is Ti for the same reason. In addition, in the general formula (A10), MIV indicates at least one type of Alkali earth metal element which is selected from Mg, Ca, Sr, Ba, and Zn, and it is preferable that MIV is Ca from brightness and stability of powder characteristics. In addition, in the general formula (A10), a value of h which indicates a composition ratio (concentration) of Mn is $0.001 \leq h \leq 0.1$ in the same manner as in the aforementioned general formula (A9), and for the same reason, it is preferable that the value of h is $0.005 \leq h \leq 0.5$.

Specifically, $Zn(Ti_{0.98}Mn_{0.02})F_6$, $Ba(Zr_{0.995}Mn_{0.005})F_6$, $Ca(Ti_{0.995}Mn_{0.005})F_6$, $Sr(Zr_{0.98}Mn_{0.02})F_6$ or the like can be used as the red phosphor which is represented by the general formula (A10), but the red phosphor is not limited to this.

The green phosphor 17 (green phosphor) is distributed in the resin 14. The green phosphor 17 is excited by blue light which is the primary light, and emits the secondary light of green (peak wavelength is equal to or greater than 500 nm and equal to or less than 550 nm) with wavelength longer than that of the primary light.

The green phosphor 17 may be β type SiAlON which is a divalent Eu-activated oxynitride phosphor that is represented by the following general formula (B1), or a divalent Eu-activated silicate phosphor which is represented by the following general formula (B2).

$$Eu_aSi_bAl_cO_dN_e \qquad \text{general formula (B1)}$$

In the general formula (B1), a value of a which indicates a composition ratio (concentration) of Eu is $0.005 \le a \le 0.4$. In a case where the value of a is less than 0.005, sufficient brightness is not obtained. In addition, in a case where the value of a exceeds 0.4, brightness is significantly reduced due to concentration quenching or the like. In addition, it is preferable that the value of a in the aforementioned general formula (B1) is $0.01 \le a \le 0.2$ from stability of powder characteristics, and homogeneity of the mother. In addition, in the general formula (B1), b indicating a composition ratio (concentration) of Si and c indicating a composition ratio (concentration) of A1 are numbers which satisfy b+c=12, and d indicating a composition ratio (concentration) of O and e indicating a composition ratio (concentration) of N are numbers which satisfy d+e=16.

Specifically, $Eu_{0.05}Si_{11.50}Al_{0.50}O_{0.05}N_{15.95}$, $Eu_{0.10}Si_{11.00}Al_{1.00}O_{0.10}N_{15.90}$, $Eu_{0.30}Si_{9.80}Al_{2.20}O_{0.30}N_{15.70}$, $Eu_{0.15}Si_{10.00}Al_{2.00}O_{0.20}N_{15.80}$, $Eu_{0.01}Si_{11.60}Al_{0.40}O_{0.01}N_{15.99}$, $Eu_{0.005}Si_{11.70}Al_{0.30}O_{0.03}N_{15.97}$ or the like can be used as the green phosphor 17 which is represented by the general formula (B1), but the green phosphor 17 is not limited to this.

$$2(Ba_{1-f-g}YI_fEu_g)O.SiO_2 \qquad \text{general formula (B2)}$$

In the general formula (B2), YI indicates at least one type of Alkali earth metal element which is selected from Mg, Ca, and Sr, and it is preferable that YI is Sr in order to obtain highly efficient mother.

In the general formula (B2), a value of f which indicates a composition ratio (concentration) of YI is $0 \le f \le 0.55$, and since the value of f is within a range thereof, it is possible to obtain green light in a range of 510 nm to 540 nm. In a case where the value of f exceeds 0.55, yellowish green light is emitted, and color purity is degraded. Furthermore, it is preferable that the value of f is within a range of $0.15 \le f \le 0.45$ from a viewpoint of efficiency and color purity. In addition, in the general formula (B2), a value of g which indicates a composition ratio (concentration) of Eu is $0.03 \le g \le 0.10$. In a case where a value of g is less than 0.03, sufficient brightness is not obtained. In a case where the value of g exceeds 0.10, brightness is significantly reduced due to concentration quenching or the like. In addition, it is preferable that the value of g is within a range of $0.04 \le g \le 0.08$ from brightness and stability of powder characteristics.

Specifically, $2(Ba_{0.70}Sr_{0.26}Eu_{0.04}).SiO_2$, $2(Ba_{0.57}Sr_{0.38}Eu_{0.05})O.SiO_2$, $2(Ba_{0.53}Sr_{0.43}Eu_{0.04})O.SiO_2$, $2(Ba_{0.82}Sr_{0.15}Eu_{0.03})O.SiO_2$, $2(Ba_{0.46}Sr_{0.49}Eu_{0.05})O.SiO_2$, $2(Ba_{0.59}Sr_{0.35}Eu_{0.06})O.SiO_2$, $2(Ba_{0.52}Sr_{0.40}Eu_{0.08})O.SiO_2$, $2(Ba_{0.85}Sr_{0.10}Eu_{0.05})O.SiO_2$, $2(Ba_{0.47}Sr_{0.50}Eu_{0.03})O.SiO_2$, $2(Ba_{0.54}Sr_{0.36}Eu_{0.10})O.SiO_2$, $2(Ba_{0.69}Sr_{0.25}Ca_{0.02}Eu_{0.04})O.SiO_2$, $2(Ba_{0.56}Sr_{0.38}Mg_{0.01}Eu_{0.05})O.SiO_2$, $2(Ba_{0.81}Sr_{0.13}Mg_{0.01}Ca_{0.01}Eu_{0.04})O.SiO_2$ or the like can be used as the green phosphor 17 which is represented by the general formula (B2), but the green phosphor 17 is not limited to this.

In addition, the green phosphor 17 may be a divalent Eu-activated silicate phosphor which is represented by the following general formula (B3).

$$2(M1_{1-g},Eu_g)O.SiO_2 \qquad \text{general formula (B3)}$$

In the general formula (B3), M1 indicates at least one type of element which is selected from Mg, Ca, Sr, and Ba, and g indicates a number which satisfies $0.005 \le g \le 0.10$.

A so-called BOSE Alkali earth metal silicate phosphor which is represented by the general formula (B3) is a phosphor of an allowed transition type in which the afterglow time which is time required until emission intensity becomes 1/e is equal to or less than 10 μs, as well as the CASN phosphor.

In the LED 11 having the aforementioned configuration, the primary light (blue light) which is emitted from the LED chip 13 passes through the resin 14. A part thereof excites the KSF phosphor 15 thereby being converted into secondary light (red light), and excites the green phosphor 17 thereby being converted into secondary light (green light). In this way, white light (mixed light) W0, which is obtained by mixing the primary blue light and the secondary red and green light, is emitted from the LED 11 to the outside of the LED 11.

(With Regard to Comparative Example)

Next, a configuration of an LED drive circuit and emission intensity of an LED according to a comparative example will be described with reference to FIG. 6 to FIG. 8.

Figure 6:
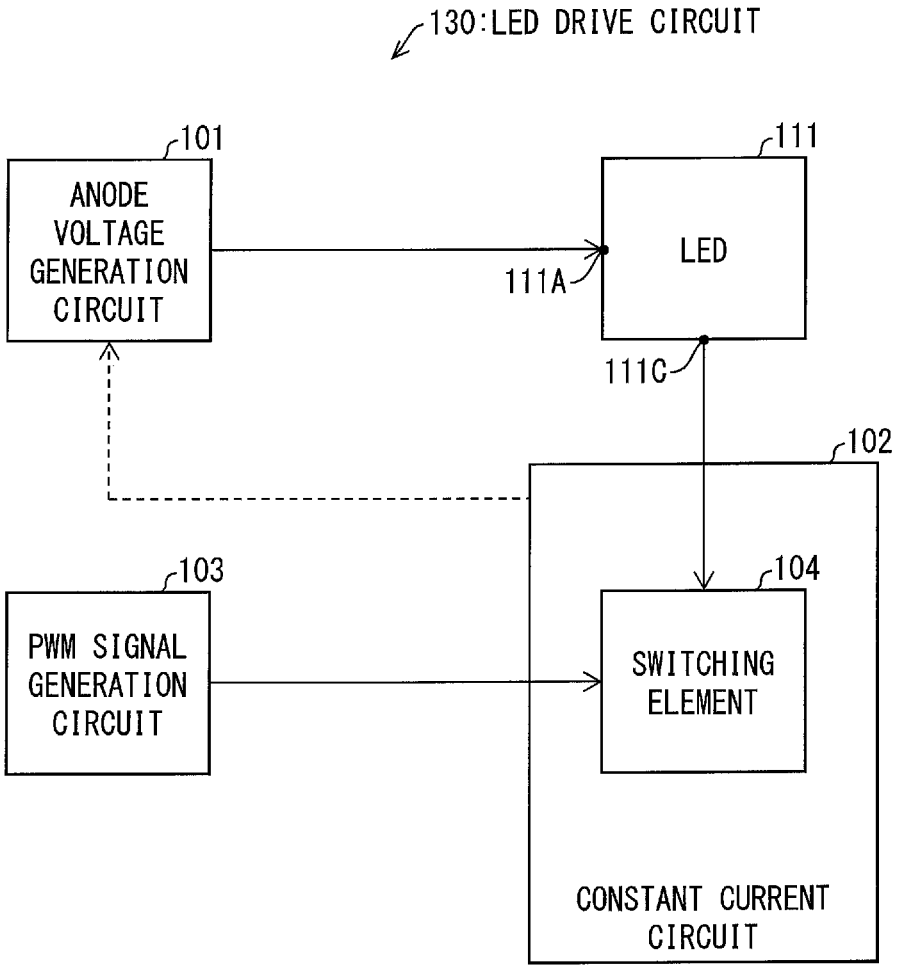
FIG. 6 is a block diagram illustrating a configuration of an LED drive circuit according to a first comparative example.

FIG. 6 is a block diagram illustrating a configuration of an LED drive circuit 130 according to a first comparative example. The LED drive circuit 130 has a configuration in which the second output circuit 6 of the LED drive circuit 30 illustrated in FIG. 1 is removed. The LED drive circuit 130 includes an anode voltage generation circuit 101, a constant current circuit 102 having a switching element 104, a PWM signal generation circuit 103, and an LED 111.

The PWM signal generation circuit 103 generates a PWM signal which is a dimming signal that is a pulse signal configured by "H"/"L", and outputs the generated PWM signal to the constant current circuit 102.

Next, if the constant current circuit 102 receives the PWM signal, the switching element 104 which is embedded in the constant current circuit 102 is ON/OFF in correspondence with a frequency and a duty cycle of the PWM signal.

The anode voltage generation circuit 101 generates VF (forward voltage) which is required for lighting the LED 111, and outputs VF to an anode 111A of the LED 111.

In addition, if the switching element 104 which is embedded in the constant current circuit 102 is ON, IF flows from the anode 111A of the LED 111 to the constant current circuit 102 through a cathode 111C, and if the switching element 104 if OFF, IF does not flow.

An anode voltage signal from the anode voltage generation circuit 101 is input to the LED 111, IF (forward current) flows through an LED chip included in the LED 111, and thereby the LED 111 emits white light.

In this way, IF flows and thereby the LED 111 emits white light only when the switching element 104 is ON, and when the switching element 104 is OFF, IF does not flow and thereby the white light is extinguished.

Figure 7:
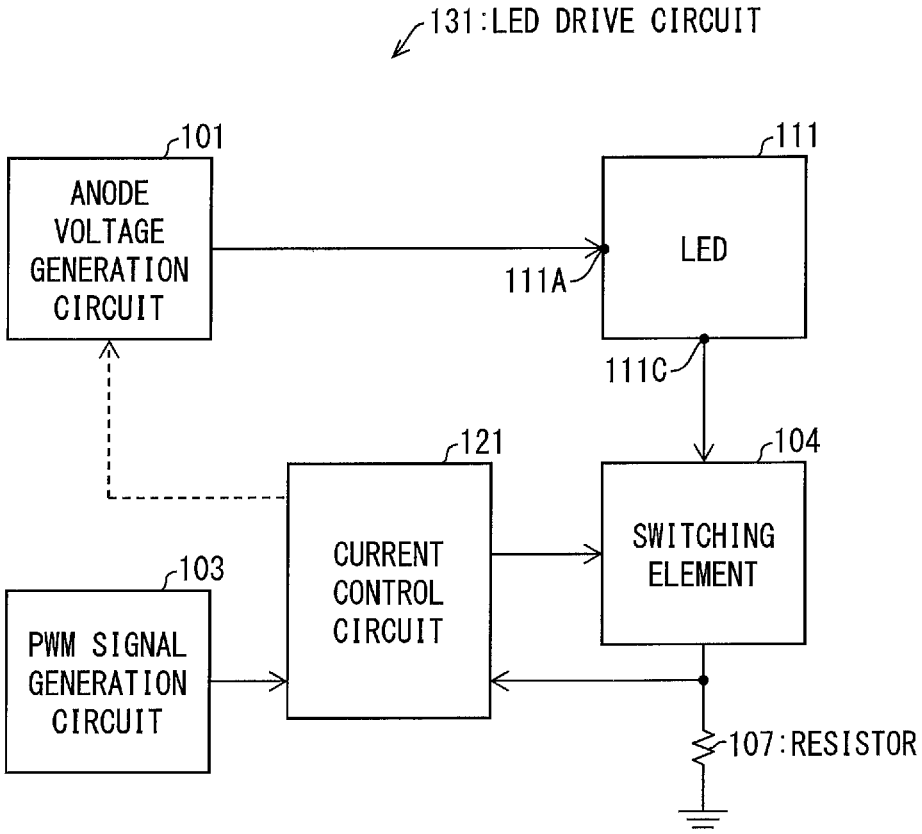
FIG. 7 is a block diagram illustrating a configuration of an LED drive circuit according to a second comparative example.

FIG. 7 is a block diagram illustrating a configuration of an LED drive circuit 131 according to a second comparative example. The LED drive circuit 131 has a configuration in which the switching element 104 is separated from the constant current circuit 102 in the LED drive circuit 130 of FIG. 6. In the LED drive circuit 131, the constant current circuit 102 in the LED drive circuit 130 is replaced with a current control circuit 121, a switching element 104, and a resistor 107.

The current control circuit 121 switches on the switching element 104 when a PWM signal which is input to the current control circuit 121 from the PWM signal generation circuit 103 goes to "H", and IF flows through the cathode 111C from the anode 111A of the LED 111, the switching element 104, and the resistor 107 from the anode voltage generation circuit 101 by VF (forward voltage) which is output from the anode voltage generation circuit 101. As a result, the LED 111 emits white light.

Meanwhile, the current control circuit 121 switches off the switching element 104 when the PWM signal which is input to the current control circuit 121 from the PWM signal generation circuit 103 goes to "L", and thereby IF does not flow through the LED 111, and the LED 111 does not emit light.

An IF value is determined by a voltage value of the resistor 107 and a resistance value of the resistor 107, when the switching element 104 is ON. The current control circuit 121 performs monitoring such that a voltage between the switching element 104 and the resistor 107 is constant at all times. For example, the voltage between the switching element 104 and the resistor 107 is adjusted so as to be 1.0 V. In a case where the voltage is equal to or lower than 1.0 V, the current control circuit 121 outputs (feeds back) a feedback signal which boosts an anode voltage to the anode voltage generation circuit 101, and if the voltage is equal to or higher than 1.0 V, the current control circuit 121 outputs the feedback signal which drops the anode voltage to the anode voltage generation circuit 101. By doing so, the voltage between the switching element 104 and the resistor 107 is 1.0 V at all times, and a constant current flows by calculating the current value using the resistance value.

A light emission state of the LEDs 111 in the LED drive circuit 130 and the LED drive circuit 131 will be described with reference to FIG. 8.

Figure 8:
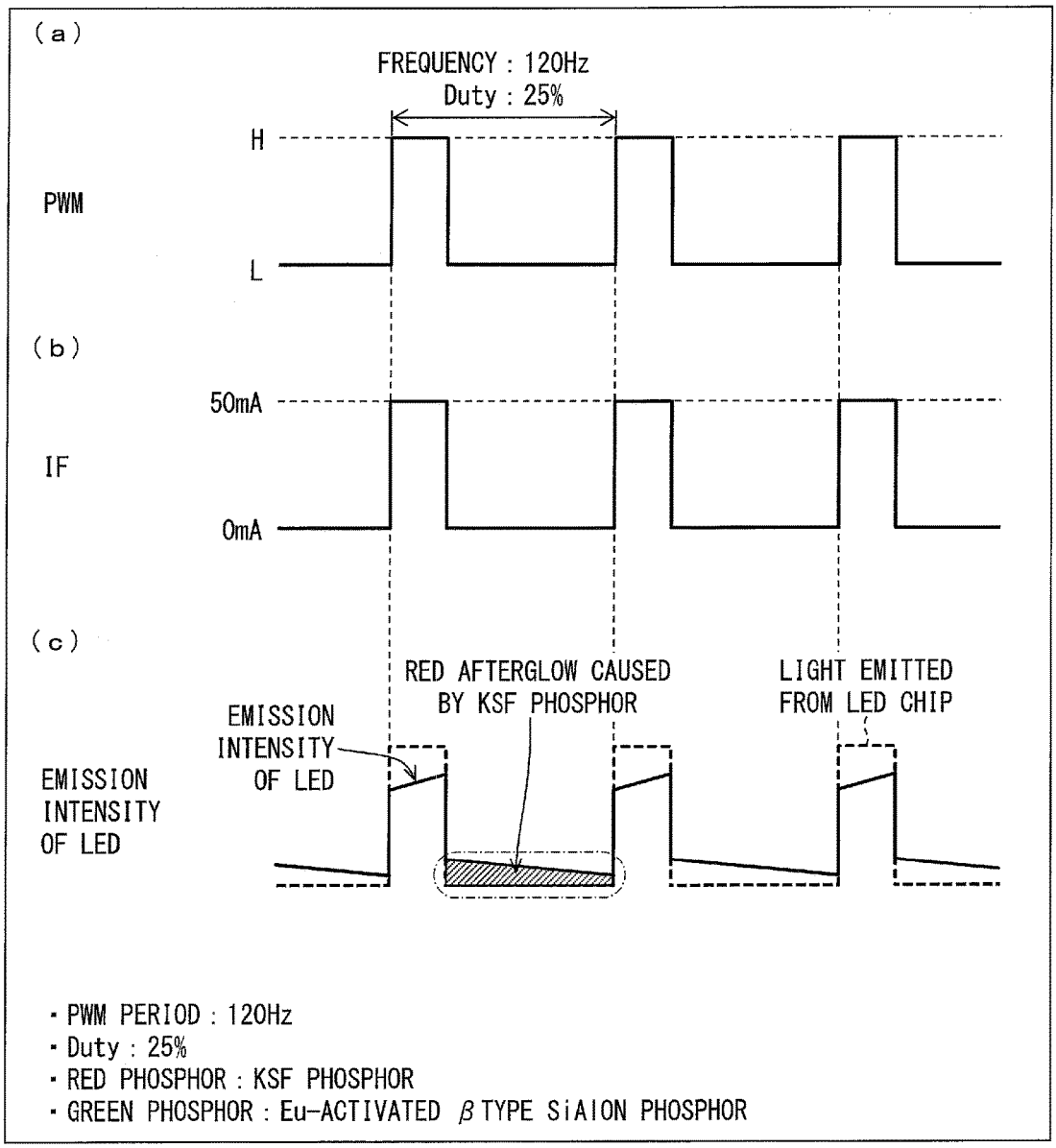
FIG. 8(*a*) illustrates a PWM signal according to the first and second comparative examples, FIG. 8(*b*) illustrates an IF signal according to the first and second comparative examples, and FIG. 8(*c*) is a diagram illustrating a light emission state of an LED according to the first and second comparative examples.

FIG. 8(*a*) illustrates the PWM signal according to the first and second comparative examples, FIG. 8(*b*) illustrates an IF signal according to the first and second comparative examples, and FIG. 8(*c*) illustrates a light emission state of the LED according to the first and second comparative examples.

In FIG. 8(*c*), light emitted from the LED chip denotes an emission state of blue light which is emitted from the LED chip included in the LED 111, and a red afterglow emitted from the KSF phosphor denotes an afterglow of the KSF phosphor after blue light, which is primary light, from the LED chip is extinguished. The PWM signal which is supplied from the PWM signal generation circuit 103 to the constant current circuit 102 has a frequency of 120 Hz, a duty cycle of 25%, and IF of 50 mA. The red phosphor is a KSF phosphor, and the green phosphor is an Eu-activated β-type SiAlON phosphor.

As illustrated in FIG. 8, the LED chip 13 emits light such that the PWM signal is a square wave corresponding to a period of "H" and "L".

However, as illustrated in FIG. 8, a response speed of the KSF phosphor is slow, and thus, when the PWM signal changes from "H" to "L", in other words, when the LED chip emitting light does not emit light, the red light which is emitted from the KSF phosphor is not immediately extinguished, the red light from the KSF phosphor remains as an afterglow, even when the PWM signal goes to "L". The LED drive circuits 130 and 131 have a phenomenon in which a displayed video is viewed with a color.

(With Respect to Main Effects of LED Drive Circuit 30)

Next, main effects of the LED drive circuit 30 according to the present embodiment will be described with reference to FIG. 1, and FIG. 9 to FIG. 11.

Figure 9:
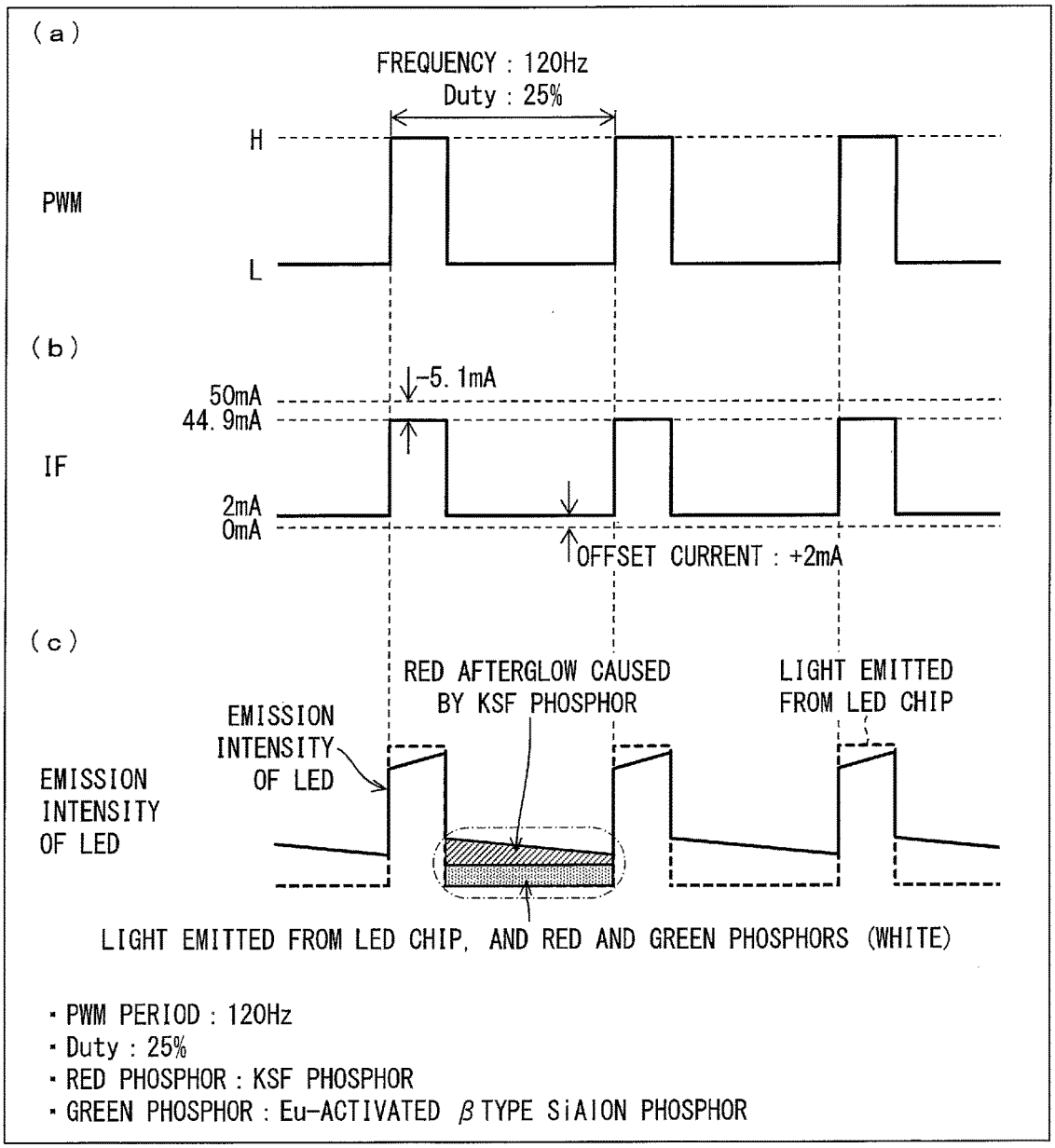
FIG. 9(*a*) illustrates a PWM signal of the LED drive circuit according to Embodiment 1, FIG. 9(*b*) illustrates an IF signal of the LED drive circuit according to Embodiment 1, and FIG. 9(*c*) is a diagram illustrating a light emission state of the LED of the LED drive circuit according to Embodiment 1.

FIG. 9(*a*) illustrates the PWM signal of the LED drive circuit 30, FIG. 9(*b*) illustrates the IF signal of the LED drive circuit 30, and FIG. 9(*c*) illustrates a light emission state of the LED of the LED drive circuit 30.

In the same manner as in the first and second comparative examples, the PWM signal which is supplied from the PWM signal generation circuit 3 to the constant current circuit 2 has a frequency of 120 Hz and a duty cycle of 25%. In addition, the red phosphor of the LED 11 is the KSF phosphor 15, and the green phosphor 17 is an Eu-activated β-type SiAlON phosphor.

If a current (referred to as an offset current) flowing from the cathode 11C of the LED 11 to the second output circuit 6 is for example, 2 mA, when the PWM signal goes to "L", that is, even when the switching element 4 is turned off, an offset current of 2 mA flows through the LED 11, and IF flows from the cathode 11C of the LED 11 to the resistor 7. In this way, the LED 11 in the LED drive circuit 30 slightly emits (fine lighting) white light, even when the PWM signal goes to "L".

In this way, in a case where the offset current of 2 mA flows through the LED 11 at all times even when the PWM signal is inactive, IF does not become the maximum value of 50 mA, but becomes 44.9 mA less than the maximum value, when the PWM signal is active. Accordingly, power (brightness) per frame can be equal to that of the LED drive circuits 130 and 131 according to the first and second comparative examples.

As illustrated in FIG. 9, in the LED drive circuit 30, when the PWM signal changes from "H" to "L", the red light which is emitted from the KSF phosphor 15 is not immediately extinguished and remains as an afterglow. Even if the PWM signal goes to "L", an offset current of 2 mA flows through the LED 11, and thus, the LED 11 emits white light. That is, according to the LED drive circuit 30, during a period in which the PWM signal is inactive, the red light which is an afterglow that is emitted from the KSF phosphor 15 is mixed with the white light which is configured by the primary light (blue light of the LED chip 13) and the secondary light (red light which is emitted from the KSF phosphor 15, and green light which is emitted from the green phosphor 17), and thereby it is possible to reduce a phenomenon in which a displayed video is viewed with a red color.

That is, as bright red of the KSF phosphor 15 is mixed with the white light, chroma becomes low, and thereby red is rarely viewed in a part of telop characters flowing on the screen. The duty cycle and offset current of the PWM signal illustrated in FIG. 9 may be changed.

Figure 10:
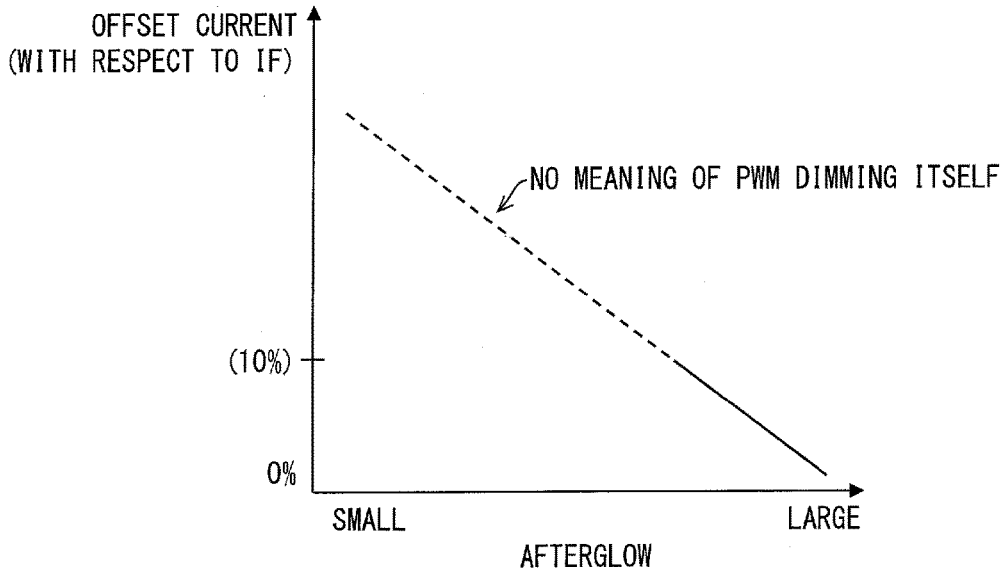
FIG. 10 is a diagram illustrating a relationship between an offset current and an afterglow.
Figure 11:
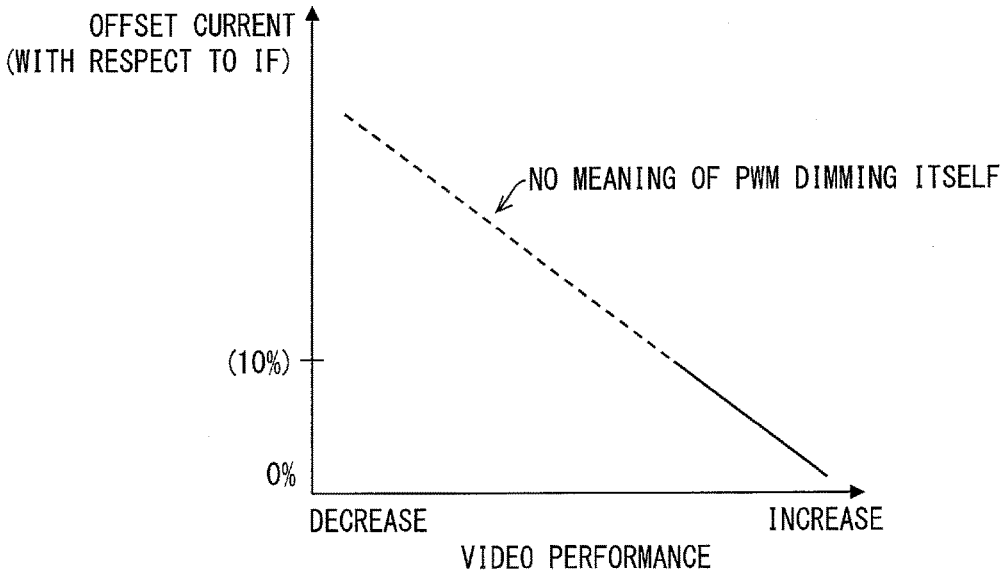
FIG. 11 is a diagram illustrating a relationship between the offset current and video performance improvement.

FIG. 10 is a diagram illustrating a relationship between an offset current and an afterglow. FIG. 11 is a diagram illustrating a relationship between the offset current and video performance improvement.

A horizontal axis of FIG. 10 denotes the amount of afterglow, and a vertical axis thereof denotes a ratio between IF and the offset current. A horizontal axis of FIG. 11 denotes video performance, and a vertical axis thereof denotes a ratio between IF and the offset current. For example, in a case where IF is 50 mA and the offset current is 2 mA, a ratio between IF and the offset current is 4%.

As illustrated in FIG. 10 and FIG. 11, if the offset current increases, emission intensity of the white light which is emitted from the LED 11 when the PWM signal goes to "L"

increases. For this reason, an afterglow (coloring) of the red light decreases, and display performance of video is reduced.

That is, there is a tradeoff relationship between the video performance and reduction of the afterglow, and thus it is preferable that appropriate adjustment is made according to use conditions of a display device or the like which uses the LED drive circuit 30. In addition, if the offset current is increased too much, there is no meaning to perform dimming the PWM signal. That is, a current value of the offset current is changed in proportion to a current value of IF.

For this reason, it is preferable that a ratio between IF and a value of the offset current is equal to or less than 10%. In addition, a drive method according to the present invention is effective with respect to drive conditions in which a coloring phenomenon due to an afterglow of a phosphor is easily viewed and an oscillation frequency of the PWM signal is equal to or lower than 120 Hz. Accordingly, it is possible to prevent display performance of video of a display device such as a liquid crystal display device which is used for the LED drive circuit 30 from decreasing, and to reduce an afterglow of the KSF phosphor 15.

It is preferable that a ratio between IF and a value of the offset current is equal to or higher than approximately 2% to 3%. If the value of the offset current is small, it is not possible to actually obtain effects of flowing of the offset current.

As described above, according to the LED drive circuit 30, when a signal level of PWM signal is "H", IF flows from the cathode 11C of the LED 11 to the first output circuit 5, and thereby the LED chip 13 of the LED 11 emits primary light. Accordingly, white light which is obtained by mixing the primary light with secondary light from the KSF phosphor 15 and the green phosphor 17 is emitted from the LED 11.

Meanwhile, when the signal level of PWM signal is "L", the first output circuit 5 stops an operation thereof, and IF does not flow from the LED 11 to the first output circuit 5. However, the second output circuit 6 receives an offset current whose value is less than that of IF from the cathode 11C, makes the current flow therein, and then outputs the current. For this reason, even when the signal level of the PWM signal is "L", the LED chip 13 emits the primary light with brightness less than primary light which is generated by IF, and thereby the LED 11 slightly emits the white light.

The first output circuit 5 and the second output circuit 6 are coupled in parallel. For this reason, even when the first output circuit 5 stops an operation thereof, the offset current flows into the LED 11 through the second output circuit 6, and the LED 11 can slightly emits light.

In this way, according to the LED drive circuit 30, even in a period in which the switching element 4 of the constant current circuit 2 is turned off and an afterglow of the KSF phosphor 15 is emitted, the LED 11 emits white light with light brightness by the second output circuit 6. Accordingly, red light of the afterglow is mixed with white light and thus, it is possible to reduce visibility of the afterglow.

As described above, a liquid crystal television is configured by using the LED drive circuit 30 or the illumination device 71, and thus, it is possible to reduce a coloring phenomenon due to an afterglow of a phosphor of a forbidden transition type which is representative of the KSF phosphor.

Here, strictly speaking, 120 Hz, 60 Hz, 60/1.001 Hz, 50 Hz, 30 Hz, 30/1.001 Hz, 25 Hz, 24 Hz, 24/1.001 Hz, or the like is used as a frame frequency of a video signal for television broadcast or the like, but here, for a brief description, currently, in consideration of a frame frequency of television broadcast standard which is used in Japan, 60 Hz and frequencies based on an integer multiple of 60 Hz are used for display on a liquid crystal panel.

However, a coloring phenomenon due to the afterglow of a phosphor of a forbidden transition type which is representative of KSF phosphor easily occurs when display of the liquid crystal panel is equal to or lower than 120 Hz. Accordingly, the LED drive circuit 30 or the illumination device 71 according to the present invention is employed in the liquid crystal television, and the present invention is effective with respect to not only a frequency based on television broadcast standard which is currently used in Japan, but also a frame frequency which is used for other television broadcast standards of other countries. That is, it is possible to reduce a coloring phenomenon due to the afterglow of a phosphor of a forbidden transition type which is representative of KSF phosphor.

This results in the same effects as in LED drive circuits which will be described in the following embodiments.

Embodiment 2

Embodiment 2 according to the present invention will be hereinafter described with reference to FIG. 12 and FIG. 20. For the sake of convenience of description, the same symbols or reference numerals will be attached to the members having the same functions as described in Embodiment 1, and description thereof will be omitted.

Figure 12:
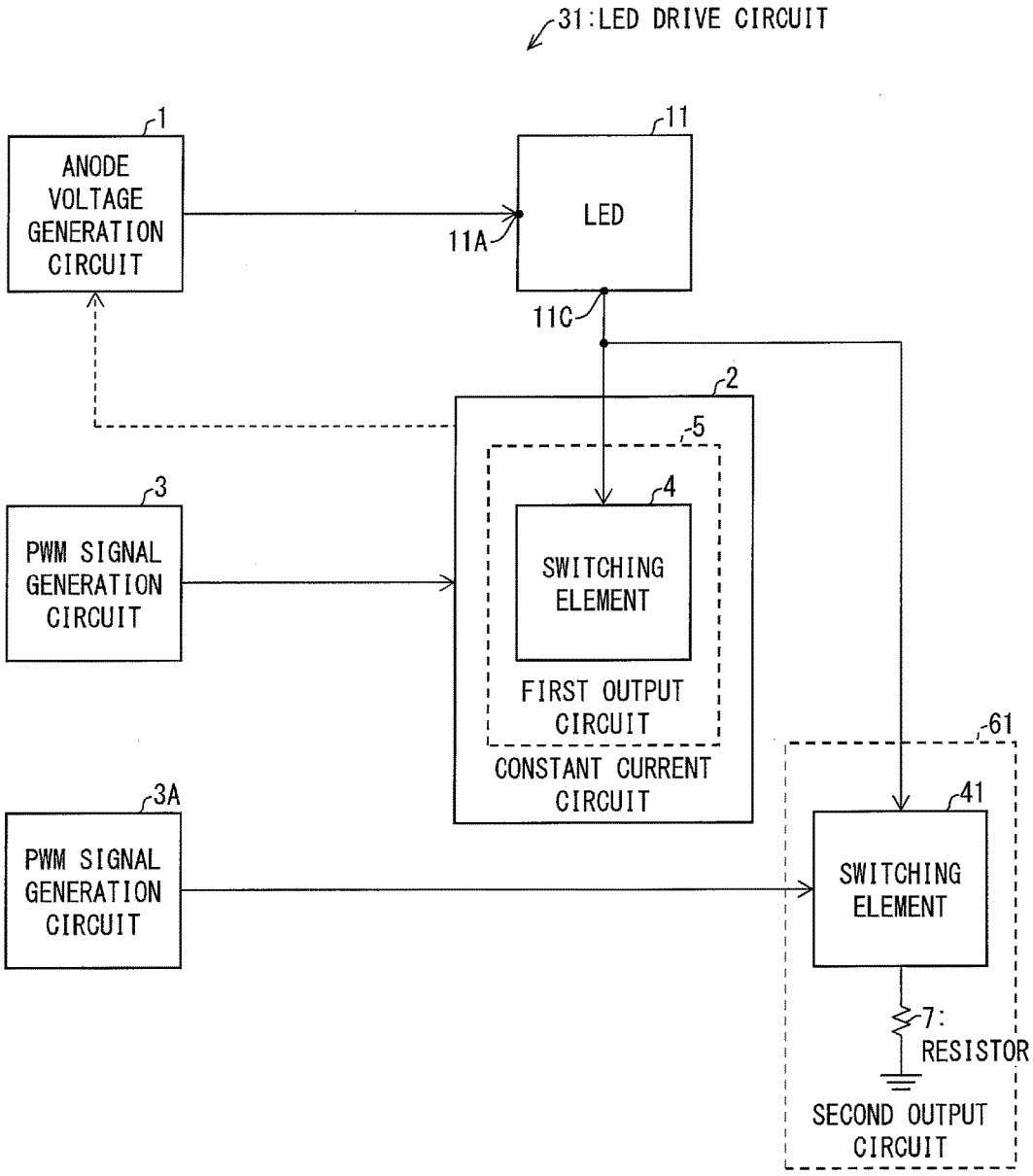
FIG. 12 is a block diagram illustrating a configuration of an LED drive circuit according to Embodiment 2.

FIG. 12 is a block diagram illustrating a configuration of an LED drive circuit (light emitting diode drive device) 31 according to Embodiment 2. The LED drive circuit 31 is different from the LED drive circuit 30 in that a second output circuit 61 and a PWM signal generation circuit 3A are included instead of the second output circuit 6. The other configurations of the LED drive circuit 31 are the same as the LED drive circuit 30.

The second output circuit 61 includes a switching element 41 in addition to the resistor 7. The cathode 11C of the LED 11 is coupled to the switching element 4 which is the first output circuit 5, and is also coupled to an input terminal of the switching element 41 of the second output circuit 61. An output terminal of the switching element 41 is coupled to one terminal of the resistor 7, and the other terminal of the resistor 7 is electrically grounded. The PWM signal generation circuit 3A is coupled to the switching element 41.

The PWM signal generation circuit 3A outputs a PWM signal to the switching element 41.

The LED drive circuit 31 separately controls the switching element 4 and the switching element 41, and thereby, when the switching element 4 is turned on, the switching element 41 can be turned off. Meanwhile, when the switching element 4 is turned off, the switching element 41 can be turned on.

In addition, if outputting of the PWM signal from the PWM signal generation circuit 3 and the PWM signal generation circuit 3A is stopped by external control, both the switching element 4 and the switching element 41 are turned off, and light which is emitted from the LED 11 can be extinguished.

Figure 20:
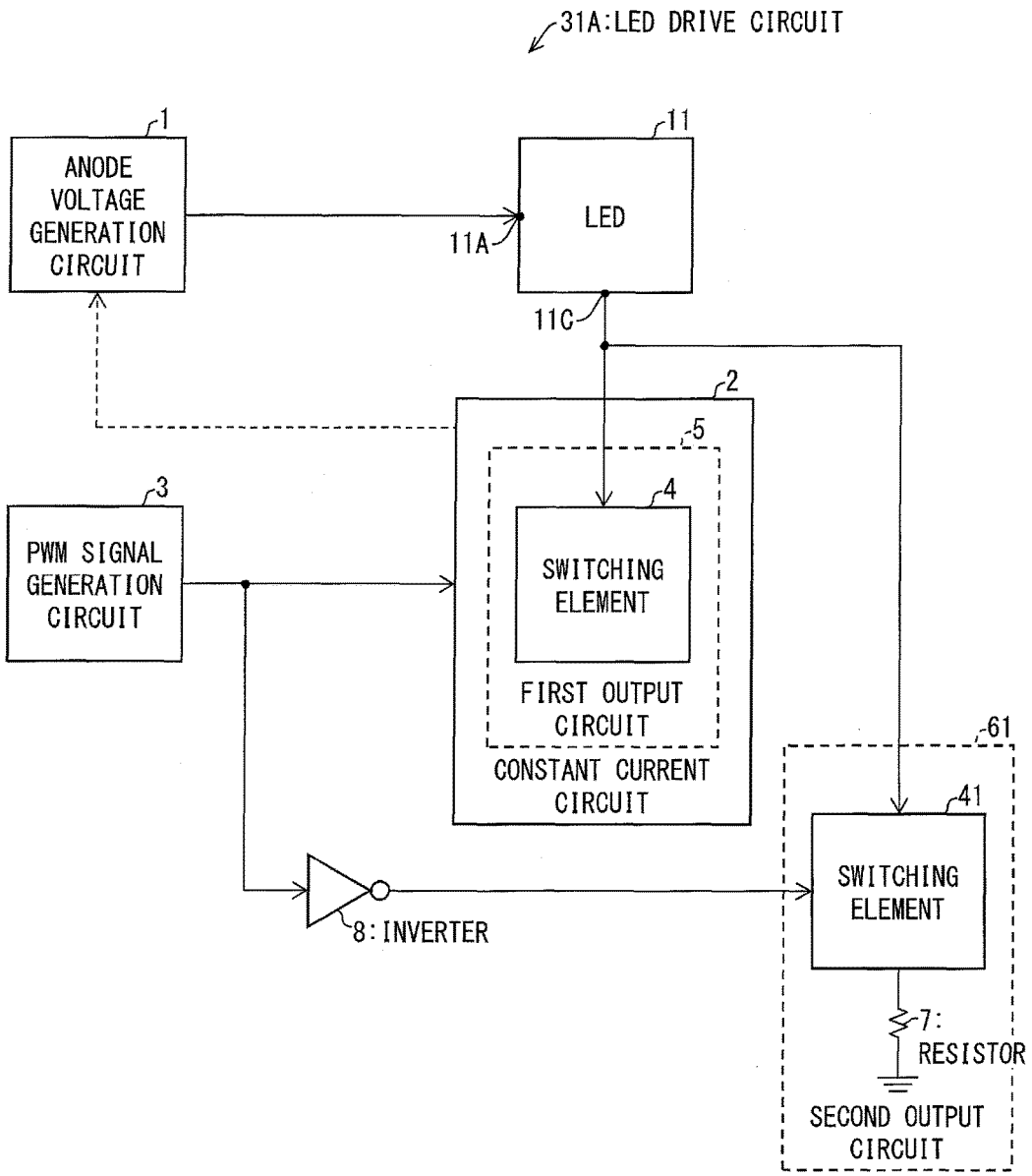
FIG. 20 is a block diagram illustrating a configuration of an LED drive circuit according to a modification example of the LED drive circuit according to Embodiment 2.

An inverted pulse that is obtained by inverting a pulse, which is output from the PWM signal generation circuit 3, by using an inverter 8 illustrated in FIG. 20 may be input to the switching element 41.

FIG. 20 is a block diagram, illustrating a configuration of an LED drive circuit (light emitting diode drive circuit) 31A which is a modification example of the LED drive circuit 31 according to Embodiment 2. The LED drive circuit 31A is different from the LED drive circuit 31 in that the inverter 8 is included instead of the PWM signal generation circuit 3A.

An input terminal of the inverter 8 is coupled to the PWM signal generation circuit 3, and an output terminal thereof is coupled to the switching element 41. By including the inverter 8 in the LED drive circuit 31A, a PWM signal which is obtained by inverting "H" and "L" of the PWM signal that is input to the switching element 4 can be input to the switching element 41.

By doing so, ON and OFF of the switching element 4 can be the reverse of ON and OFF of the switching element 41.

According to the LED drive circuit 31, when the PWM signal which is output from the PWM signal generation circuit 3 to the constant current circuit 2 goes to "H", the switching element 4 is turned on, and at the same time, the PWM signal which is output from the PWM signal generation circuit 3A to the switching element 41 goes to "L", and thereby the switching element 41 is turned off. For this reason, when the PWM signal goes to "H", IF flowing through the LED 11 flows from the cathode 11C to the first output circuit 5 only, among the first output circuit 5 and the second output circuit 61. By doing so, the LED 11 emits white light.

Meanwhile, when the PWM signal which is output from the PWM signal generation circuit 3 to the constant current circuit 2 goes to "L", the switching element 4 is turned off, and at the same time, the PWM signal which is output from the PWM signal generation circuit 3A to the switching element 41 goes to "H", and thereby the switching element 41 is turned on. For this reason, IF flowing through the LED 11 flows from the cathode 11C to the second output circuit 61 only, among the first output circuit 5 and the second output circuit 61. Accordingly, when the PWM signal which is output from the PWM signal generation circuit 3 to the constant current circuit 2 goes to "L", the LED 11 emits white light with very little brightness.

As a result, according to the LED drive circuit 31, even in a period in which the switching element 4 of the constant current circuit 2 is turned off and thereby an afterglow is emitted from the KSF phosphor 15, the white light with very little brightness is emitted from the LED 11 by the second output circuit 61. Accordingly, red light and white light of the afterglow are mixed together, and thus, it is possible to reduce visibility of the afterglow. The LED drive circuit 31A illustrated in FIG. 20 can also obtain the same effects as the LED drive circuit 31.

In FIG. 12, as the PWM signal of "L" is output from both the PWM signal generation circuit 3 and the PWM signal generation circuit 3A, both the switching element 4 and the switching element 41 are turned off, and light which is emitted from the LED 11 is extinguished.

As described above, according to the LED drive circuit 31, driving of the constant current circuit 2 and driving of the second output circuit 61 can be separately controlled, and thus, it is possible to extinguish the light which is emitted from the LED 11 by turning off the switching elements 4 and 41, without stopping the output from the anode voltage generation circuit 1 (as output), compared to the LED drive circuit 30 described in Embodiment 1.

Embodiment 3

Embodiment 3 of the present invention will be hereinafter described with reference to FIG. 13. For the sake of convenience of description, the same symbols or reference numerals will be attached to the members having the same functions as described in Embodiment 1 and Embodiment 2, and description thereof will be omitted.

Figure 13:
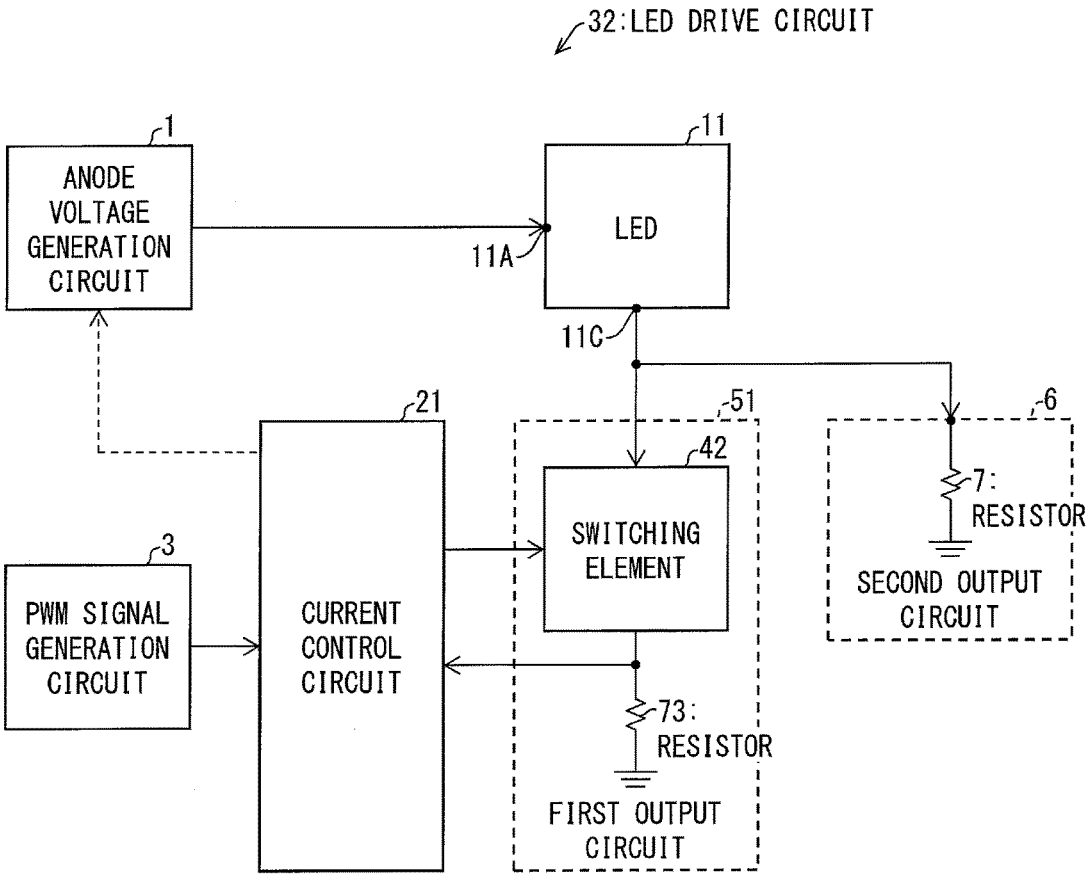
FIG. 13 is a block diagram illustrating a configuration of an LED drive circuit according to Embodiment 3.

FIG. 13 is a block diagram illustrating a configuration of an LED drive circuit (light emitting diode drive device) 32 according to Embodiment 3. The LED drive circuit 32 is different from the LED drive circuit 30 in that a current control circuit 21 and a first output circuit 51 are included instead of the constant current circuit 2. The other configurations of the LED drive circuit 32 are the same as the LED drive circuit 30. The LED drive circuit 32 is different from the LED drive circuit 30 in that the first output circuit 51 is disposed in the outside of the current control circuit 21. The first output circuit 51 includes a switching element 42 and a resistor 73.

A first input terminal of the current control circuit 21 is coupled to the PWM signal generation circuit 3, a second input terminal thereof is coupled to a first output terminal of the switching element 42. A first output terminal of the current control circuit 21 is coupled to the anode voltage generation circuit 1, and a second output terminal thereof is coupled to the switching element 42.

The cathode 11C of the LED 11 is coupled to a second input terminal of the switching element 42 of the first output circuit 51 and one terminal of the resistor 7 which is the second output circuit 6.

In the first output circuit 51, a first input terminal of the switching element 42 is coupled to a second output terminal of the current control circuit 21, and a second input terminal thereof is coupled to the cathode 11C of the LED 11. An output terminal of the switching element 42 is coupled to a second input terminal of the current control circuit 21, and one terminal of the resistor 73. The other terminal of the resistor 73 is electrically grounded.

A current output from the current control circuit 21 flows into GND through the switching element 42. In a case where of using the current control circuit 21, an IF value of the LED 11 is determined by resistance between a voltage of the switching element 42 and GND. Then, since the voltage of the switching element 42 is required to be retained constant, a feedback signal to the anode voltage generation circuit 1 is essential.

As an example, in a case where an Nch FET is used for the switching element 42, the first input terminal of the switching element 42 becomes a gate terminal, the second terminal becomes a drain terminal, and the first output terminal becomes a source terminal.

The PWM signal of "H" or "L" which is output from the PWM signal generation circuit 3 is input to the current control circuit 21, and the current control circuit 21 outputs the PWM signal which turns on or off the switching element 42.

At this time, the current control circuit 21 may have a function of boosting required for turning on the switching element 42. For example, in a case where the PWM signal ("H") of 3.3 V is output from the PWM signal generation circuit 3 and an ON voltage of a gate terminal of an Nch FET is 10 V, the function indicates that the signal of 3.3 V is boosted to 12 V or the like, and is output to the switching element 42.

The anode voltage generation circuit 1 generates an anode voltage signal required for lighting the LED 11, and the generated anode voltage signal is output to the anode 11A of the LED 11 thereby being supplied to the LED 11.

In addition, IF flows into the switching element 42 and the resistor 7 of the second output circuit 6 from the cathode 11C of the LED 11, and thereby the LED 11 emits white light.

When the PWM signal which is input from the PWM signal generation circuit 3 goes to "H", the current control circuit 21 turns on the switching element 42, and thereby a current flows through the LED 11 and the LED 11 emits light.

In this case, a current flowing through the second output circuit is determined by a voltage which is obtained by subtracting a VF value of the LED 11 from the anode voltage signal, and a resistance value of the resistor 73. Furthermore, a current flowing through the first output circuit 51 is determined by a voltage value of the resistor 73 and a resistance value of the resistor 73, when the switching element 42 is on.

The current control circuit 21 monitors a voltage value and feeds back the monitored results to the anode voltage generation circuit 1, such that a voltage between the switching element 42 and the resistor 73 is maintained constant at all times, when the switching element 42 is turned on and the LED 11 emits light.

For example, a voltage between the switching element 42 and the resistor 73 is adjusted so as to be 1.0 V. In a case where the voltage is 1.0 V or less, the current control circuit 21 outputs (feeds back) the feedback signal which boosts an anode voltage to the anode voltage generation circuit 1. In a case where the voltage is equal to or higher than 1.0 V, the current control circuit 21 outputs the feedback signal which drops the anode voltage to the anode voltage generation circuit 1. By doing so, the voltage between the switching element 42 and the resistor 73 becomes 1.0 V. In a case where the resistance value is 20Ω, a current of IF which is 50 mA flows through the LED 11.

Meanwhile, when the PWM signal which is input from the PWM signal generation circuit 3 goes to "L", the current control circuit 21 turns off the switching element 42, and thereby a current flows into only the resistor 7 of the second output circuit 6. For example, when the switching element 42 is OFF, a current of IF which is 2 mA flows through the second output circuit 6, in a case where a voltage of the cathode 11C of the LED 11 is 10 V and the resistor 7 is 5 kn. Accordingly, the LED 11 slightly emits light with brightness of approximately 2/(50+2), compared to brightness when IF=50 mA which flows at the time of turning on the switching element 42.

Hence, the switching element 42 is turned on/off according to a frequency and a duty cycle of PWM signal, and thereby the LED 11 repeats emission of light and slight emission of light by a constant current.

If the anode voltage signal is input to the anode 11A, the LED 11 makes IF flow from the cathode 11C to the second output circuit 6. By doing so, when the PWM signal goes to "L", that is, when the switching element 42 is turned off, the LED 11 makes a current flow into the second output circuit 6, thereby slightly emitting white light.

According to the LED drive circuit 32, in a case where the number of the LEDs 11 which are coupled in series is large, that is, even in a case where VF exceeds a rated voltage (breakdown voltage) of a constant current circuit, it is possible to prevent breakdown of a circuit such as the current control circuit 21 by simply increasing the rated voltage of the switching element 42 only.

Embodiment 4

Embodiment 4 of the present invention will be hereinafter described with reference to FIG. 14 and FIG. 15. For the sake of convenience of description, the same symbols or reference numerals will be attached to the members having the same functions as described in Embodiment 1 to Embodiment 3, and description thereof will be omitted.

Figure 14:
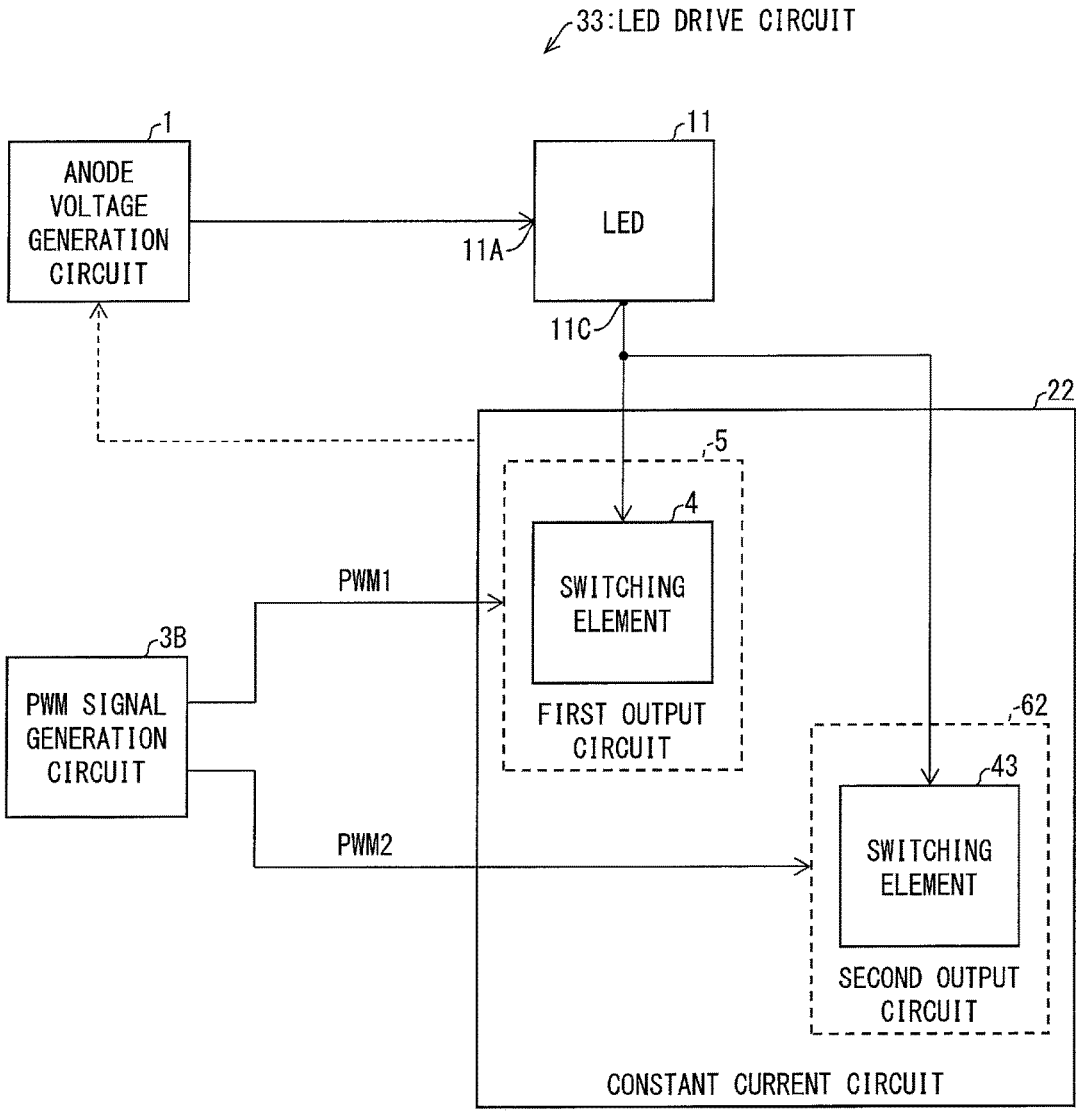
FIG. 14 is a block diagram illustrating a configuration of an LED drive circuit according to Embodiment 4.

FIG. 14 is a block diagram illustrating a configuration of an LED drive circuit (light emitting diode drive device) 33 according to Embodiment 4. FIG. 15(*a*) illustrates a first PWM signal PWM1 of the LED drive circuit 33, FIG. 15(*b*) illustrates a second PWM signal PWM2 of the LED drive circuit 33, and FIG. 15(*c*) illustrates an IF signal of the LED drive circuit 33, and FIG. 15(*d*) illustrates a light emission state of the LED 11 of the LED drive circuit 33.

The LED drive circuit 33 illustrated in FIG. 14 is different from the LED drive circuit 30 in that a constant current circuit 22 and a PWM signal generation circuit (PWM signal generation unit) 3B are included instead of the constant current circuit 2, the PWM signal generation circuit 3, and the second output circuit 6. The other configuration of the LED drive circuit 33 is the same as the LED drive circuit 30. In the LED drive circuit 33, the second output circuit 62 is also embedded in the constant current circuit 22 in addition to the first output circuit 5.

The PWM signal generation circuit 3B generates the first PWM signal PWM1 and the second PWM signal PWM2, and outputs the first PWM signal PWM1 and the second PWM signal PWM2 to the constant current circuit 22.

Figure 15:
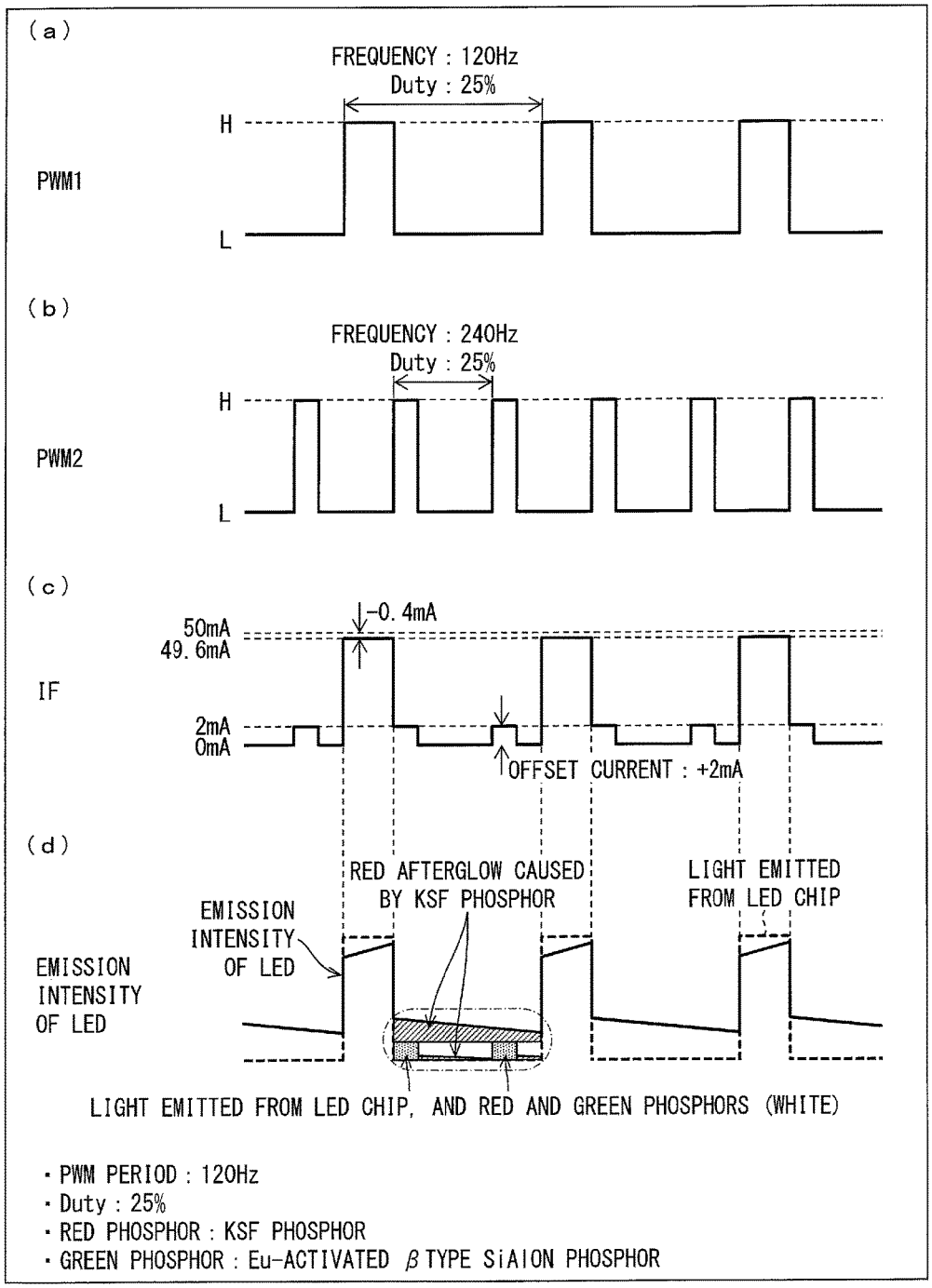
FIG. 15(*a*) illustrates a first PWM signal PWM of the LED drive circuit according to Embodiment 4, FIG. 15(*b*) illustrates a second PWM signal PWM of the LED drive circuit according to Embodiment 4, and FIG. 15(*c*) illustrates an IF signal of the LED drive circuit according to Embodiment 4, and FIG. 15(*d*) illustrates an LED light emission state of the LED drive circuit according to Embodiment 4.

As illustrated in FIGS. 15(*a*) and 15(*b*), the second PWM signal PWM2 goes to "H", when the first PWM signal PWM1 goes to "L". The second PWM signal PWM2 rises at the same time when the first PWM signal PWM1 falls. The second PWM signal PWM2 has a frequency higher than that of the first PWM signal PWM1. As an example, the frequency of the first PWM signal PWM1 is 120 Hz, and the frequency of the second PWM signal PWM2 is 240 Hz. Duty cycles of the first PWM signal PWM1 and the second PWM signal PWM2 are 25% in common.

As illustrated in FIG. 14, the constant current circuit 22 includes the first output circuit 5, and the second output circuit 62. The first output circuit 5 is configured with the switching element 4. The second output circuit 62 is configured with the switching element 43.

The switching element 4 is turned on when the first PWM signal which is input from the PWM signal generation circuit 3B goes to "H", and is turned off when the first PWM signal goes to "L". The switching element 43 is turned on when the second PWM signal which is input from the PWM signal generation circuit 3B goes to "H", and is turned off when the second PWM signal goes to "L". That is, the switching element 43 is turned on when the switching element 4 is turned off, and is turned off when the switching element 4 is turned on.

In addition, IF flows from the cathode 11C of the LED 11 to the switching element 4 or the switching element 43, and thereby the LED 11 emits white light. The current which flows from the cathode 11C of the LED 11 to the switching element 43 is an offset current which makes the LED 11 slightly emit light.

In the LED drive circuit 33, the first PWM signal PWM1 and the second PWM signal PWM2 are separately input to each of the first output circuit 5 and the second output circuit 62 which are coupled in parallel, and thereby the first output circuit 5 and the second output circuit 62 can be driven in parallel. For this reason, the offset current which flows through the LED 11 as the second output circuit 62 is activated can be arbitrarily changed depending on a value of IF which flows through the LED 11 as the first output circuit 5 is activated.

In addition, the constant current circuit 22 includes both the switching element 4 and the switching element 43, and can separately control each of them. For this reason, when the switching element 4 is turned off, PWM control of the switching element 43 is performed, and thus, it is possible to switch ON/OFF of the offset current which flows through the LED 11.

Light emission intensity of the LED 11 in this case is illustrated in FIG. 15. In FIG. 15, if the first PWM signal PWM1 which is input to the switching element 4 changes from "H" to "L", the second PWM signal PWM2 which is input to the switching element 43 changes from "L" to "H" simultaneously.

The second PWM signal PWM2 has a frequency of 240 Hz which is higher than that of the first PWM signal PWM1 and a duty cycle thereof is 25% which is the same as that of the first PWM signal PWM1, and thus, while the first PWM signal PWM1 is in "L", the second PWM signal PWM2 outputs two pulses.

As illustrated in FIG. 15(*c*), in a case where a value of the offset current of a pulse type is 2 mA, the value coincides with the light emission intensity of the LED per frame illustrated in FIG. 8(*c*), and thus, IF becomes 49.6 mA with respect to a maximum value of 50 mA.

As illustrated in FIG. 15(*d*), when the switching element 4 is turned off and thereby the LED 11 starts to emit a red afterglow by using the KSF phosphor, that is, when the first PWM signal PWM1 changes from "H" to "L", the second output circuit 62 is activated, and thereby the LED 11 slightly emits the white light. Thereby, the red light which is emitted from KSF phosphor is mixed with the white light, and it is possible to reduce visibility of an afterglow.

In addition, in the LED drive circuit 33, when the first output circuit 5 is turned off, that is, an afterglow of the red light is generated, the second output circuit 62 is driven in plural times. Thereby, the second output circuit 62 is driven at a high frequency and thus, the LED drive circuit obtains the same effect as when the second output circuit is activated, at all times and the offset current flowing through the LED 11 has a pulse shape. Accordingly, the LED 11 does not emit light at all times, and it is possible to further obtain afterimage reduction effects of a display device such as a liquid crystal display device.

IF illustrated in FIG. 15, the offset current, frequencies and duty cycles of each PWM signal which are illustrated are an example, and the present invention is not limited to these.

Embodiment 5

Embodiment 5 of the present invention will be hereinafter described with reference to FIG. 16. For the sake of convenience of description, the same symbols or reference numerals will be attached to the members having the same functions as described in Embodiment 1 to Embodiment 4, and description thereof will be omitted.

Figure 16:
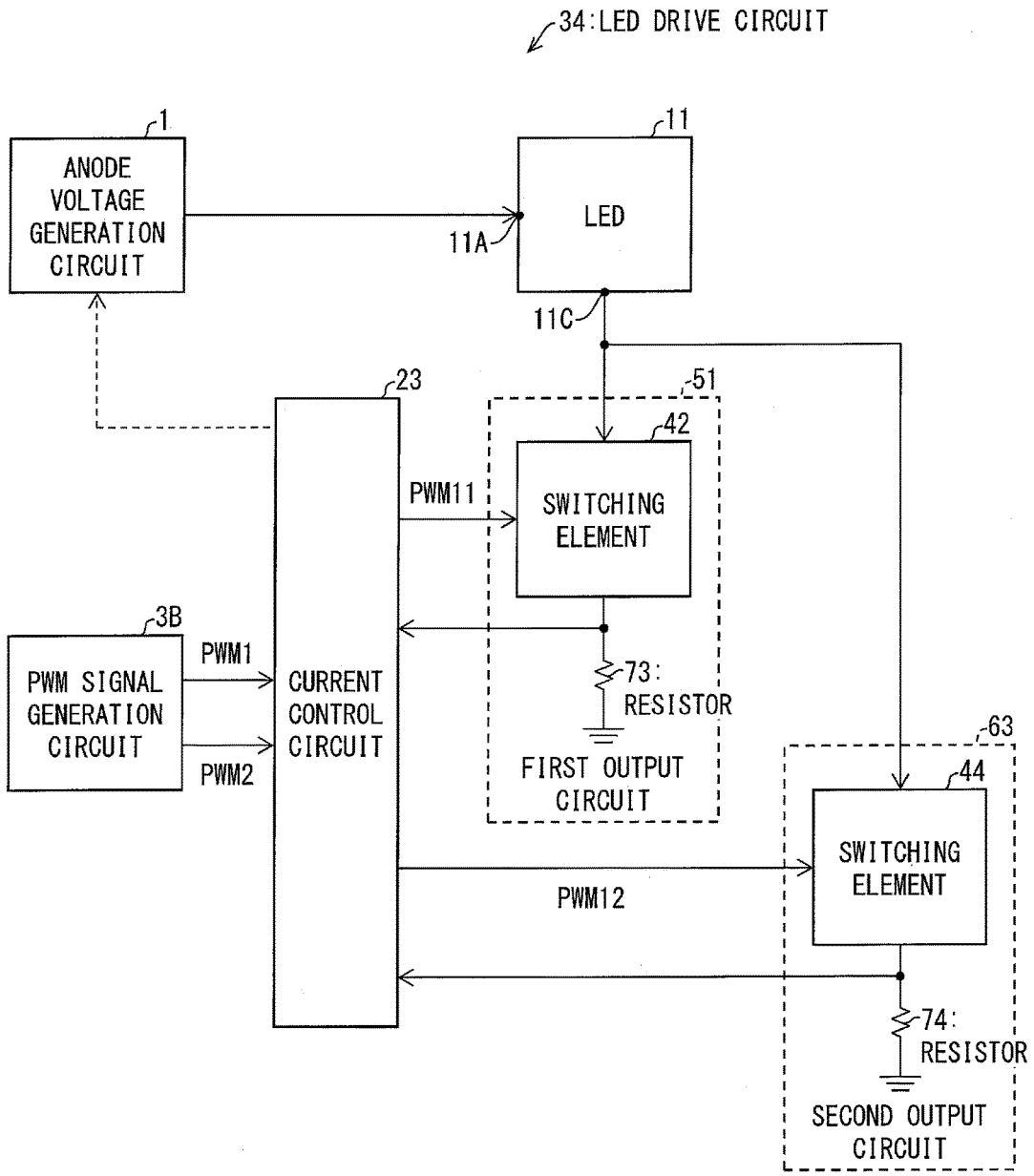
FIG. 16 is a block diagram illustrating a configuration of an LED drive circuit according to an embodiment.
Figure 19:
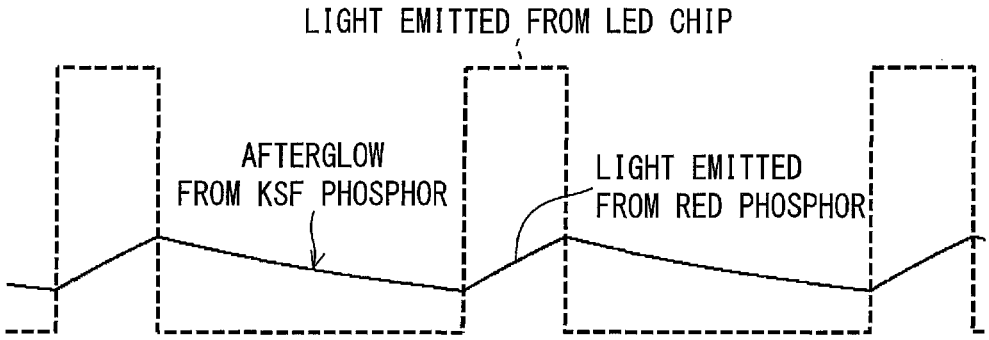
FIG. 19 is a diagram illustrating light emission states of blue light and red light of an LED according to a PWM signal of an LED of the related art which uses a KSF phosphor.

FIG. 16 is a block diagram of a configuration of an LED drive circuit (light emitting diode drive device) 34 according to Embodiment 5.

The LED drive circuit 34 is different from the LED drive circuit 33 illustrated in FIG. 14 in that a current control circuit 23, a first output circuit 51, and a second output circuit 63 are included instead of the constant current circuit 22. The other configuration of the LED drive circuit 34 is the same as the LED drive circuit 33.

The first output circuit 51 and the second output circuit 63 are disposed in the outside of the current control circuit 23. The second output circuit 63 includes a switching element 44 and a resistor 74.

One terminal of the resistor 74 is coupled to an output terminal of the switching element 44, and the other terminal thereof is electrically grounded. An offset current which makes the LED 11 slightly emit light flows through the switching element 44.

As the switching element 42 of the first output circuit 51 and the switching element 44 of the second output circuit 63 are turned on or off respectively and separately, IF can flow through the LED 11 at arbitrary timings, respectively.

The anode voltage generation circuit 1 generates an anode voltage signal, and outputs the generated anode voltage signal to the anode 11A of the LED 11, thereby supplying the anode voltage signal to the LED 11. In addition, As IF flows from the cathode 11C of the LED 11 to the switching element 42 or the switching element 44, the LED 11 emits white light. A current which flows from the cathode 11C of the LED 11 to the switching element 44 is the offset current of the LED 11.

The current control circuit 23 generates the first PWM signal PWM11 which is a pulse signal that turns on/off the switching element 42 in correspondence with "H" and "L" of the first PWM signal PWM1 from the PWM signal generation circuit 3B, and outputs the generated first PWM signal PWM11 to the switching element 42. Thereby, the current control circuit 23 turns on the switching element 42, when the first PWM signal PWM1 which is input from the PWM signal generation circuit 3B goes to "H". Thereby, while corresponding to "H" of the first PWM signal PWM1 from the PWM signal generation circuit 3B, IF flowing through the LED 11 flows from the cathode 11C to the first output circuit 51. Thereby, the LED 11 emits the white light.

Meanwhile, when the first PWM signal PWM1 which is output from the PWM signal generation circuit 3B to the current control circuit 23 goes to "L", the switching element 42 turns off, and IF does not flow from the cathode 11C of the LED 11 to the first output circuit 51.

The current control circuit 23 generates the second PWM signal PWM12 which is a pulse signal that turns on/off the switching element 44 in correspondence with "H" and "L" of the second PWM signal PWM2 from the PWM signal generation circuit 3B, and outputs the generated second PWM signal PWM12 to the switching element 44. Thereby, the current control circuit 23 turns on the switching element 44, when the second PWM signal PWM2 which is input from the PWM signal generation circuit 3B goes to "H". Thereby, while corresponding to "H" of the second PWM signal PWM2 from the PWM signal generation circuit 3B, IF flowing through the LED 11 flows from the cathode 11C to the second output circuit 63. Thereby, the LED 11 slightly emits the white light.

Meanwhile, when the second PWM signal PWM2 which is output from the PWM signal generation circuit 3B to the current control circuit 23 goes to "L", the switching element 44 turns off, and IF does not flow from the cathode 11C of the LED 11 to the second output circuit 63.

When the switching element 42 is turned on and thereby the LED 11 emits light, the current control circuit 23 monitors a voltage value such that a voltage between the switching element 42 and the resistor 73 is maintained constant, and outputs the results to the anode voltage generation circuit 1 as a feedback signal thereby feeding back the signal.

Furthermore, when the switching element 44 is turned on and thereby the LED 11 slightly emits the light, the current control circuit 23 monitors a voltage value such that a voltage between the switching element 44 and the resistor 74 is maintained constant, and outputs the results to the anode voltage generation circuit 1 as the feedback signal thereby feeding back the signal.

Here, the second PWM signal PWM2 goes to "H", when the first PWM signal PWM1 goes to "L". The second PWM signal PWM2 rises at the same time when the first PWM signal PWM1 falls.

As described above, by controlling the first PWM signal PWM1 and the second PWM signal PWM2, the second output circuit 63 is activated thereby making the LED 11 slightly emit the white light, when the switching element 42 is turned off and thereby the LED 11 starts to emit a red afterglow by using KSF phosphor 15, that is, when the first PWM signal PWM1 changes from "H" to "L". Thereby, the red light which is emitted from KSF phosphor 15 is mixed with the white light, and it is possible to reduce visibility of an afterglow.

As an example, the frequency of the first PWM signal PWM1 is 120 Hz, and the frequency of the second PWM signal PWM2 is 240 Hz. Duty cycles of the first PWM signal PWM1 and the second PWM signal PWM2 are 25% in common.

EXAMPLE

FIG. 17 is a diagram illustrating an example of values of each signal which is used for each LED drive circuit.

FIG. 18 is a diagram illustrating an example of values of each signal which is used for LED drive circuits 130 and 34.

FIG. 17 illustrates specific numerical values of (1) offset current, (2) duty cycle of PWM signal, (3) IF, (4) VF1, (5) VF2 of offset current, and (6) power which are used for the LED drive circuit 130, the LED drive circuit 30, and the LED drive circuits 32 and 33 according to the comparative examples described in the embodiments. In addition, FIG. 18 illustrates specific numerical values of (1) offset current, (2) duty cycle of first PWM signal PWM1, (7) duty cycle of second PWM signal PWM2, (3) IF, (4) VF1, (5) VF2 of offset current, and (6) power which are used for the LED drive circuits 130 and 34.

(4) VF1 is a forward voltage which is applied to the LED 11 so as to make IF flow. (5) VF2 of offset current is a forward voltage which is applied to the LED 11 so as to make the offset current flow through the LED 11.

Values illustrated in (4) and (5) are calculated by IF-VF characteristics, and here, the values are roughly calculated values.

(6) power is a value which is obtained by calculating $(1)\times(100\%-(2))\times(5)+(2)\times(3)\times(4)$.

FIG. 17 and FIG. 18 illustrate an example of a case where an offset current of a case where (6) power is equal between each LED drive circuits, and IF are changed. According to general characteristics of an LED, if IF changes, VF also changes, and if the value of IF increases, the value of VF also increases.

The numerical values of each signal illustrated in FIG. 17 and FIG. 18 are an example.

CONCLUSION

A light emitting diode drive device (LED drive circuits 30 to 34) according to a first aspect of the present invention includes a light emitting diode (LED 11) which includes a light emitting diode chip (LED chip 13) being driven by a drive current that changes depending on a signal level of a square wave (PWM signal) and emits primary light with brightness corresponding to the drive current, and a phosphor (KSF phosphor 15) which is excited by the primary light and emits secondary light, and which emits mixed light that is obtained by mixing the primary light with the secondary light; and first output circuits 5 and 51 and second output circuits 6, 61, and 62 which are coupled to the light emitting diode chip and are coupled to an output terminal (cathode 11C) of the light emitting diode from which the drive current is output, In addition, the first output circuit is driven when the signal level of the square wave is a first level ("H") thereby making the light emitting diode chip emit light as a first current is output from the output terminal, and stops drive when the signal level of the square wave is a second level ("L"). In addition, the second output circuit makes the light emitting diode chip emit light as a second current (offset current) whose current value is less than that of the first current is output from the output terminal, when the signal level of the square wave is the second level ("L").

According to the configuration, when the signal level of the square wave is the first level, the first current flows from an output terminal of the light emitting diode to the first output circuit, and thereby the light emitting diode chip emits the primary light. Thereby, a mixed light which is obtained by mixing the primary light with the secondary light is emitted from the light emitting diode.

Meanwhile, when the signal level of the square wave is the second level, the first output circuit stops driving, and thus, the first current does not flow from the light emitting diode to the first output circuit. However, the second current whose value is less than that of the first current flows from the output terminal of the light emitting diode by the second output circuit. For this reason, when a signal level of the square wave is the second level, the light emitting diode chip emits the primary light with lower brightness than that of the primary light which is generated by the first current, and thereby, the light emitting diode slightly emits white light.

Hence, an afterglow of the phosphor which is generated when the signal level of the square wave is the second level is mixed with the white light which is slightly emitted, and thereby, it is possible to reduce visibility of the afterglow of the red light.

In the first aspect, in the light emitting diode drive device according to a second aspect of the present invention, it is preferable that the square wave is a PWM signal, a frequency of the PWM signal is equal to or lower than 120 Hz, and the current value of the second current is equal to or less than 1/10 of a current value of the first current.

According to the configuration, it is possible to prevent display performance of video of a display device which is used for light emitting diode drive device from decreasing, and to reduce an afterglow.

In the first aspect, the light emitting diode drive device according to a third aspect of the present invention may further include a PWM signal generation unit which generates a first PWM signal that is the square wave and a second PWM signal whose signal level becomes the first level in a period in which the signal level of the first PWM signal is the second level, in which the first output circuit may be driven when the signal level of the first PWM signal is the first level, and stops driving when the signal level of the first PWM signal is the second level, and in which the second output circuit may include a switching element which is turned on when the signal level of the second PWM signal is the first level, and is turned off when the signal level of the second PWM signal is the second level.

According to the configuration, the first output circuit and the second output circuit can be separately driven. Thereby, it is possible to further increase image display quality of a display device which is used for light emitting diode drive device.

In the first to third aspects, in the light emitting diode drive device according to a fourth aspect of the present invention, it is preferable that a current value of the second current changes in proportion to a current value of the first current.

In the first or second aspect, in the light emitting diode drive device according to a fifth aspect of the present invention, it is preferable that the second output circuit includes a switching element which is turned on when the first output circuit stops driving; and a resistor having one terminal which is coupled to an output terminal of the switching element, and the other terminal which is electrically grounded.

According to the configuration, when the first output circuit stops driving, a second current is output from an output terminal of the light emitting diode through the second output circuit, and thus, it is possible to make the light emitting diode slightly emit light.

In the first to fifth aspects, in the light emitting diode drive device according to a sixth aspect of the present invention, it is preferable that the first output circuit is coupled in parallel to the second output circuit. According to the configuration, even when the first output circuit stops driving, a second current is output from the light emitting diode through the second output circuit, and thus, it is possible to make the light emitting diode slightly emit light.

Here, normally, LEDs (including multiple pieces) are driven by one channel, as a method of driving the LEDs. However, in a case where a current flowing through one channel is not sufficient, LEDs are simultaneously driven in parallel by using multiple channels.

According to the configuration, the multiple light emitting diodes are not driven simultaneously, and can be driven at a different frequency or a different timing.

In the first aspect, in the light emitting diode drive device according to a seventh aspect of the present invention, it is preferable that the light emitting diode chip is a blue LED chip which emits blue light, the phosphor includes a red phosphor which emits red light by the blue light and a green phosphor which emits green light by the blue light, and the red phosphor is a phosphor which emits the red light by forbidden transition.

In the seventh aspect, in the light emitting diode drive device according to an eighth aspect of the present invention, it is preferable that the red phosphor is an $Mn^{4+}$-activated complex fluoride phosphor.

The illumination device 71 according to a ninth aspect of the present invention may include the light emitting diode drive device in the first to eighth aspects. According to the configuration, it is possible to obtain an illumination device which reduces visibility of an afterglow of the phosphor that is generated when a signal level of the square wave is a second level.

In the first to eighth aspects, in the light emitting diode drive device according to a tenth aspect of the present invention, the second output circuit may have a resistor (7 or 74) having one terminal which is coupled to an output terminal of the light emitting diode, and the other terminal which is electrically grounded.

In the first to eighth aspects and the tenth aspect, in the light emitting diode drive device according to a eleventh aspect of the present invention, the first output circuit may be configured by a switching element which is turned on when the first output circuit is at the first level.

In the eleventh aspect, in the light emitting diode drive device according to a twelfth aspect of the present invention, the first output circuit may further include a resistor (73) having one terminal which is coupled to an output terminal of the switching element and the other terminal which is electrically grounded.

In the third aspect, the light emitting diode drive device according to a thirteenth aspect of the present invention may include a PWM signal generation unit which generates a first PWM signal that is the square wave and a second PWM signal whose signal level becomes the first level and a second level in a period in which the signal level of the first PWM signal is the second level. In addition, the first output circuit may be driven when the signal level of the first PWM signal is the first level, and may stop driving when the signal level of the first PWM signal is the second level. In addition, the second output circuit may include a switching element which is turned on when the signal level of the second PWM signal is the first level, and is turned off when the signal level of the second PWM signal is the second level.

The present invention is not limited to the aforementioned each embodiment, various modifications can be made in a range described in the claims, and an embodiment which is obtained by appropriately combining technical means that are respectively disclosed in other embodiments also included in a technical range of the present invention. Furthermore, it is possible to configure novel technical characteristics by combining the technical means which are respectively disclosed in each embodiment.

INDUSTRIAL APPLICABILITY

The present invention can be used for a light emitting diode drive device and an illumination device.

REFERENCE SIGNS LIST

1 ANODE VOLTAGE GENERATION CIRCUIT
2 CONSTANT CURRENT CIRCUIT
3,3*a* PWM SIGNAL GENERATION CIRCUIT (PWM SIGNAL GENERATION UNIT)
4 SWITCHING ELEMENT
5,51 FIRST OUTPUT CIRCUIT
6,61,62,63 SECOND OUTPUT CIRCUIT
7 RESISTOR
11 LED (LIGHT EMITTING DIODE)
11A ANODE
11C CATHODE
13 LED CHIP (LIGHT EMITTING DIODE CHIP)
14 RESIN
15 KSF PHOSPHOR (PHOSPHOR, RED PHOSPHOR, $Mn^{4+}$-ACTIVATED COMPLEX FLUORIDE PHOSPHOR)
17 GREEN PHOSPHOR
21,23 CURRENT CONTROL CIRCUIT
22 CONSTANT CURRENT CIRCUIT
30 TO 34 LED DRIVE CIRCUIT (LIGHT EMITTING DIODE DRIVE DEVICE)
41 TO 44 SWITCHING ELEMENT
71 ILLUMINATION DEVICE
73,74 RESISTOR
W0 WHITE LIGHT (MIXED LIGHT)

The invention claimed is:

1. A light emitting diode drive device comprising:

a light emitting diode that includes a light emitting diode chip being driven by a drive current that changes depending on a signal level of a square wave and that emits primary light with brightness corresponding to the drive current, and two or more types of phosphors that are excited by the primary light and emit secondary light, and that emit mixed light that is obtained by mixing the primary light with the secondary light; and a first output circuit and a second output circuit that are coupled to the light emitting diode chip and are coupled to an output terminal of the light emitting diode from which the drive current is output, respectively, wherein the two or more types of phosphors include at least a phosphor that emits light by forbidden transition and a phosphor that emits light by allowed transition, the first output circuit is driven when the signal level of the square wave is a first level thereby making the light emitting diode chip emit light as a first current is output from the output terminal, and stops driving when the signal level of the square wave is a second level, and the second output circuit makes the light emitting diode chip emit light as a second current whose current value is less than that of the first current is output from the output terminal, when the signal level of the square wave is the second level.

2. The light emitting diode drive device according to claim 1, wherein the square wave is a PWM signal, wherein a frequency of the PWM signal is equal to or lower than 120 Hz, and wherein the current value of the second current is equal to or less than 1/10 of a current value of the first current.

3. The light emitting diode drive device according to claim 1, further comprising:

PWM signal generation circuitry that generates a first PWM signal that is the square wave and a second PWM signal whose signal level becomes the first level in a period in which the signal level of the first PWM signal is the second level, wherein the first output circuit is driven when the signal level of the first PWM signal is the first level, and stops driving when the signal level of the first PWM signal is the second level, and the second output circuit includes a switching element that is turned on when the signal level of the second PWM signal is the first level, and is turned off when the signal level of the second PWM signal is the second level.

4. The light emitting diode drive device according to claim 1, wherein a current value of the second current changes in proportion to a current value of the first current.

5. The light emitting diode drive device according to claim 1, wherein the second output circuit includes, a switching element which is turned on when the first output circuit stops driving, and a resistor having one terminal which is coupled to an output terminal of the switching element, and the other terminal which is electrically grounded.

6. The light emitting diode drive device according to claim 1, wherein the first output circuit is coupled in parallel to the second output circuit.

7. The light emitting diode drive device according to claim 1, wherein the light emitting diode chip is a blue LED chip that emits blue light, the phosphor that emits light by forbidden transition and the phosphor that emits light by allowed transition are each a red phosphor that emits red light in response to blue light, and the two or more types of phosphors further include a green phosphor that emits green light in response to the blue light.

8. The light emitting diode drive device according to claim 7, wherein the red phosphor is an Mn4+-activated complex fluoride phosphor.

9. An illumination device comprising:

the light emitting diode drive device according to claim 1.

* * * * *